US011680586B2

(12) United States Patent
Baldas et al.

(10) Patent No.: US 11,680,586 B2
(45) Date of Patent: Jun. 20, 2023

(54) SUPERSONIC EJECTOR WITH ANNULAR CHAMBER

(71) Applicants: COVAL, Montelier (FR); INSTITUT NATIONAL DES SCIENCES APPLIQUEES DE TOULOUSE, Toulouse (FR)

(72) Inventors: Lucien Baldas, Castanet Tolosan (FR); Stéphane Orieux, Montlaur (FR); Loïc Joguet, Soyons (FR); Michel Cecchin, Montelier (FR); Pierre Milhau, Chatuzange-le-Goubet (FR)

(73) Assignees: COVAL, Montelier (FR); INSTITUT NATIONAL DES SCIENCES APPLIQUEES DE TOULOUSE, Toulouse (FR)

( * ) Notice: Subject to any disclaimer, the term of this patent is extended or adjusted under 35 U.S.C. 154(b) by 138 days.

(21) Appl. No.: 16/961,618

(22) PCT Filed: Jan. 11, 2019

(86) PCT No.: PCT/EP2019/050621
§ 371 (c)(1),
(2) Date: Aug. 13, 2020

(87) PCT Pub. No.: WO2019/138032
PCT Pub. Date: Jul. 18, 2019

(65) Prior Publication Data

US 2020/0370569 A1 Nov. 26, 2020

(30) Foreign Application Priority Data

Jan. 12, 2018 (FR) ..... 18 50267

(51) Int. Cl.
*F04F 5/20* (2006.01)
*F04F 5/46* (2006.01)

(52) U.S. Cl.
CPC ..... *F04F 5/20* (2013.01); *F04F 5/463* (2013.01); *F04F 5/466* (2013.01)

(58) Field of Classification Search
CPC .... F04F 5/40; F04F 5/464; F04F 5/465; F04F 5/466
See application file for complete search history.

(56) References Cited

U.S. PATENT DOCUMENTS 1,543,834 A 6/1925 Ehrhart
1,563,752 A * 12/1925 Kothny ..... F04F 5/42 417/161
2013/0232723 A1 9/2013 Catalfamo

FOREIGN PATENT DOCUMENTS

FR 1451539 A 1/1966
GB 191129381 A 4/1912
WO WO-2014/170374 A1 10/2014

* cited by examiner

*Primary Examiner* — Kenneth J Hansen
(74) *Attorney, Agent, or Firm* — Muncy, Geissler, Olds & Lowe, P.C.

(57) ABSTRACT

A Venturi type ejector having a feed duct for feeding fluid under pressure with the duct extending along a central axis. A first expansion chamber is connected to the feed duct; a first mixing chamber is connected to the expansion chamber; a first suction chamber is connected to the mixing chamber; and an exhaust chamber is connected to the first mixing chamber. The ejector where the fluid under pressure penetrates into the first expansion chamber along a plurality of directions extends in a plane that is substantially orthogonal to the central axis. A vacuum generator includes such an ejector.

19 Claims, 28 Drawing Sheets

SUPERSONIC EJECTOR WITH ANNULAR CHAMBER

FIELD OF THE INVENTION

The present invention relates to the field of vacuum gripping, and more particularly to vacuum generator devices.

BACKGROUND OF THE INVENTION

A vacuum generator device generally comprises a Venturi ejector having a compressed air feed duct extending along a longitudinal axis, with an air inlet connecting the feed duct to an expansion chamber. The ejector also has a mixing chamber connected to an air outlet of the expansion chamber. The expansion chamber is also connected firstly to an exhaust chamber via an exhaust port and secondly to a suction chamber having its output connected to a network that is to be connected to reduced pressure. The feed duct, the expansion chamber, the mixing chamber, and the exhaust chamber are successive cylindrical or frustoconical volumes along a longitudinal central axis, and the suction chamber is a cylindrical volume having its central axis extending substantially perpendicularly to the longitudinal axis. Interposed between the feed duct and the expansion chamber, certain ejectors also comprise a convergent-divergent nozzle for accelerating the flow of air.

In operation, the air inserted into the feed duct expands in the expansion chamber, thereby creating a turbulent entrainment phenomenon at the boundary of the jet of air leaving the expansion chamber. This entrainment generates a zone of low pressure that is used to create reduced pressure in the suction chamber. In ejectors provided with a nozzle, air is accelerated in the nozzle before entering into the expansion chamber.

Such an ejector is bulky and requires the compressed air to be fed perpendicularly to the interface for connection to the network that is to be connected to reduced pressure. Modulating the vacuum level in order to obtain either the maximum degree of vacuum (suction flow rate zero—object for handling obstructing the outlet from the suction chamber) or else the maximum suction flow rate (outlet from the suction chamber open to the atmosphere) requires either an additional device at the outlet from the suction chamber or else a device for modulating the flow rate of the compressed air feed. Such devices are expensive and bulky, which makes them difficult to install on existing installations.

OBJECT OF THE INVENTION

An object of the invention is to improve the compactness of a vacuum generator device.

SUMMARY OF THE INVENTION

To this end there is provided a Venturi type ejector comprising a feed duct for feeding fluid under pressure, the duct extending along a central axis of the ejector, a first expansion chamber including a first fluid inlet connected to the feed duct, a first mixing chamber connected to a first fluid outlet of the expansion chamber, a first suction chamber connected to a first suction port of the mixing chamber, an exhaust chamber connected to a first exhaust port of the first mixing chamber and communicating with an outlet port of the ejector, and a connection interface for connection to a network that is to be connected to reduced pressure, which interface is in fluid-flow communication with the first suction chamber. According to the invention, the fluid under pressure penetrates into the first expansion chamber along a plurality of directions extending in a plane that is substantially orthogonal to the central axis.

Such an ejector presents improved compactness compared with prior art Venturi ejectors.

Advantageously, the injector includes at least one housing for expansion of the fluid under pressure and of section, when considered in a plane that is orthogonal to the central axis, that defines an angular sector of apex situated on the central axis.

In a preferred embodiment, the first expansion chamber and/or the first mixing chamber and/or the first suction chamber are annular chambers coaxial about the axis of the feed duct.

Such an arrangement further improves the compactness of the assembly.

Advantageously, the feed duct is a cylindrical volume of central axis.

Also advantageously, the first expansion chamber, the first mixing chamber, the first suction chamber, and the exhaust chamber are defined respectively by rotating a first expansion generator curve, a first mixing generator curve, and a first suction generator curve about the central axis.

A still more compact design is obtained when each of the first expansion and the mixing generator curves possesses an axis of symmetry that is orthogonal to the central axis.

The efficiency of the ejector of the invention is improved when the first mixing chamber includes a second suction port connected to a second suction chamber, the first and second suction chambers being in fluid-flow connection with each other.

Advantageously, the first and second suction chambers are connected together by at least one right cylinder of axis parallel to the central axis. Such a Venturi ejector is thus easier to manufacture and less expensive.

In a particular embodiment, the injector includes volume-varying means for varying the volume of the first mixing chamber. It is thus possible, with a single ejector, to obtain performance that is targeted either on the vacuum level or on the suction flow rate.

The efficiency of the ejector of the invention is particularly improved when the ejector includes an additional expansion stage comprising a second annular expansion chamber connected to a second annular mixing chamber, a second suction port connecting the second annular mixing chamber to the first suction chamber, a flap being interposed between the second suction port and the interface for connection to a network that is to be connected to reduced pressure. The additional expansion provided by the additional expansion stage also serves to reduce the sound level of the Venturi ejector.

In a preferred embodiment, the ejector of the invention comprises a cylindrical feed block of axis that coincides with the central axis and that has a top face and a bottom face having at its center a cylindrical tubular feed portion extending along the central axis, a bore connecting the top face of the feed block to the inside volume of the tubular feed portion. The ejector of the invention also comprises:

- a cylindrical suction block of axis coinciding with the central axis and that has a top face and a bottom face, a cylindrical blind tubular suction portion projecting along the central axis of the top face of the suction block, at least one suction channel connecting the top face of the suction block to the bottom face of the suction block;

a first mixer body that is in the form of a disk of axis coinciding with the central axis and having a first rim projecting axially from its top face, the first rim defining a first housing for receiving the feed block, the first mixer body including a central frustoconical hole connecting together the top face and the bottom face of the first mixer body, the greatest diameter of the hole extending level with the top face of the first mixer body; and a second mixer body that is in the form of a disk of axis coinciding with the central axis and having a second rim projecting axially from its bottom face, the second rim defining a second housing for receiving the suction block, the second mixer body including a central frustoconical hole connecting together the top face and the bottom face of the second mixer body, the greatest diameter of the hole extending level with the bottom face of the second mixer body.

Such a design enables parts that can be injection-molded easily to be assembled together in a manner that is simple, e.g. by adhesive, thereby leading to manufacturing costs that are reduced.

Manufacturing costs can be further reduced when the first mixer body and the second mixer body are parts that are identical and that are mounted symmetrically about a plane that is orthogonal to the central axis.

Finally, the invention provides a vacuum generator including an ejector of the above-specified type.

Other characteristics and advantages of the invention appear on reading the following description of particular, nonlimiting embodiments of the invention.

BRIEF DESCRIPTION OF THE DRAWINGS

Reference is made to the accompanying figures, in which.

DETAILED DESCRIPTION OF THE INVENTION

Figure 1:
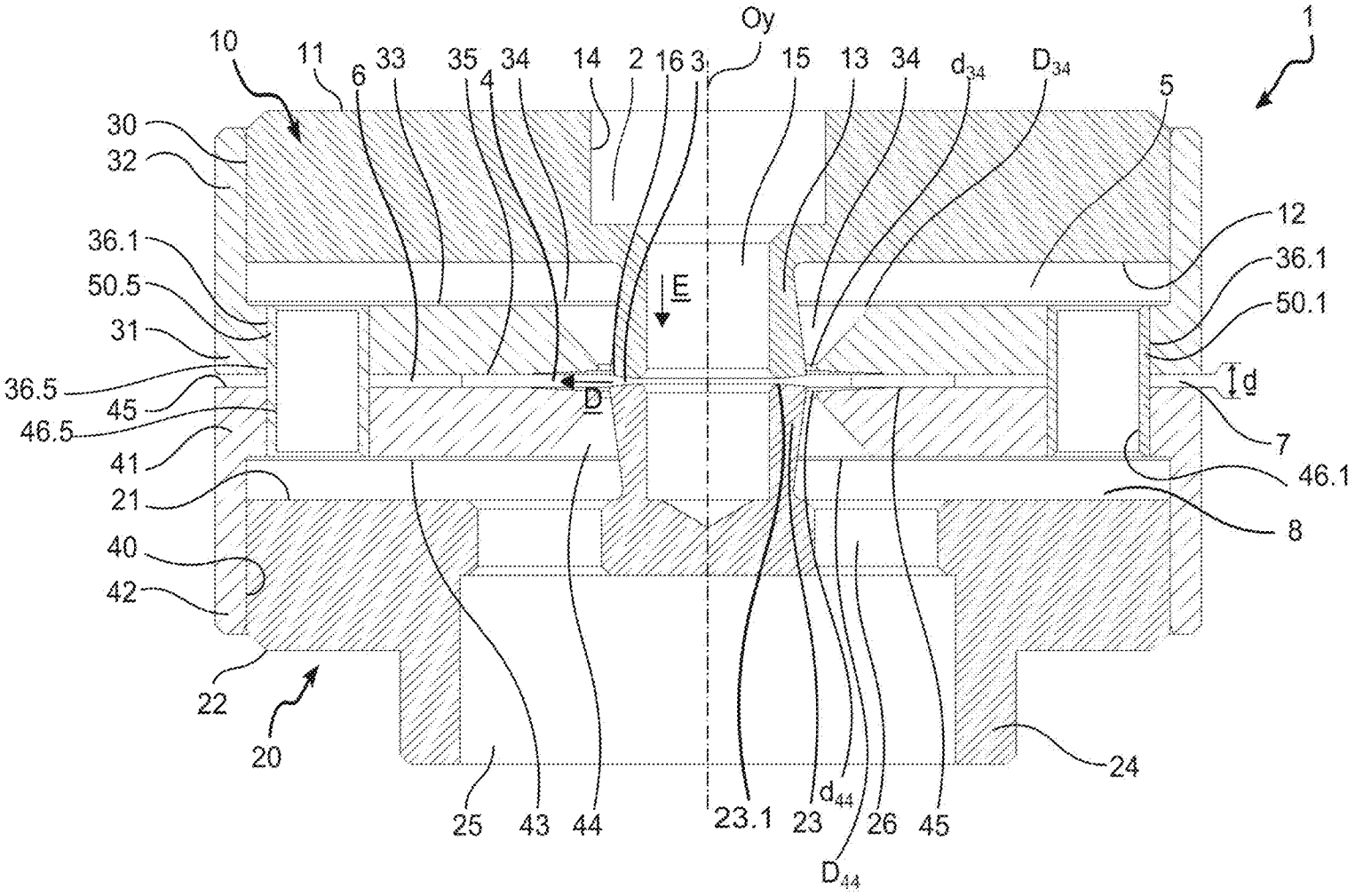
FIG. 1 is a diagrammatic section view of a first embodiment of the ejector of the invention.
Figure 2:
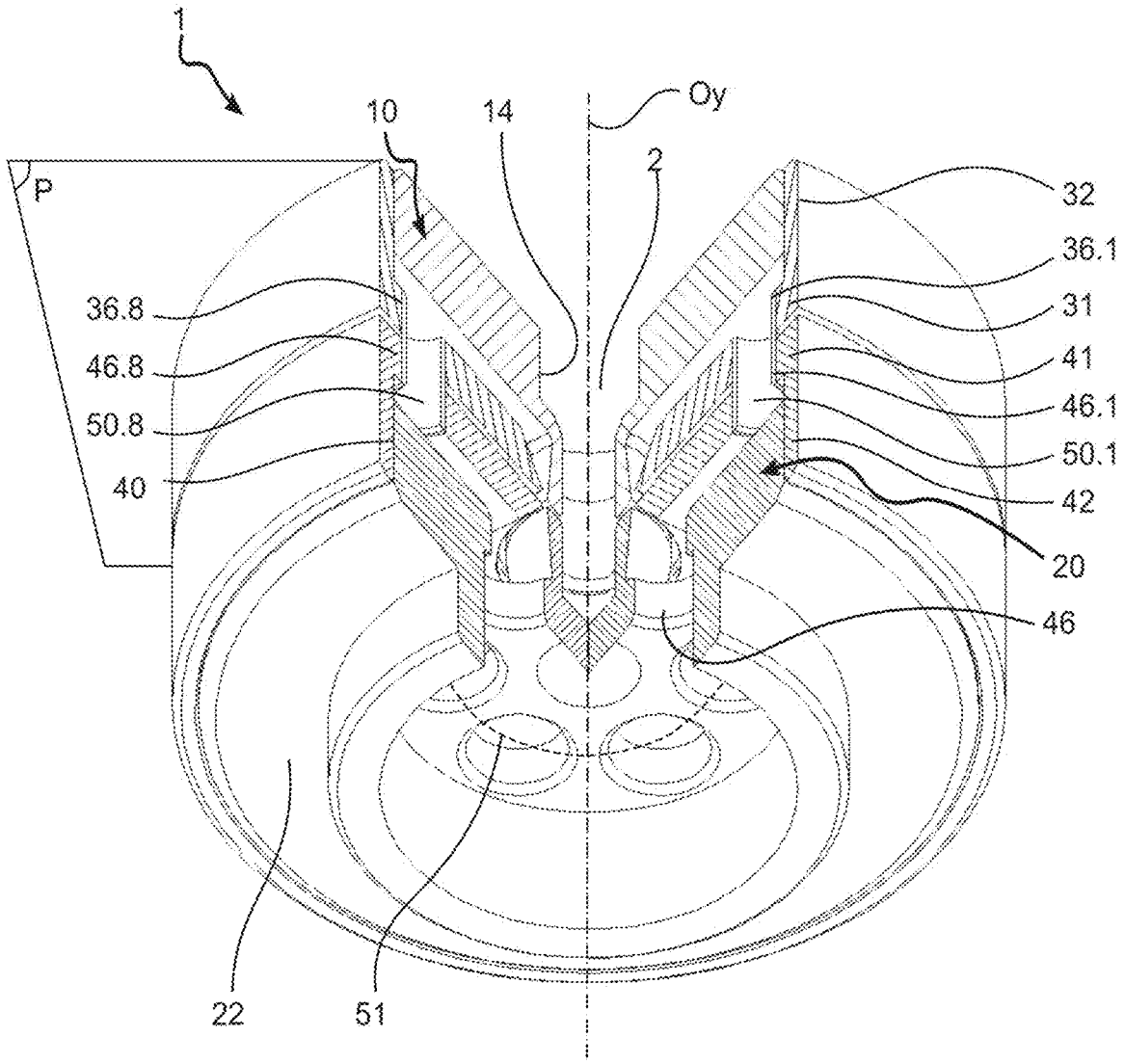
FIG. 2 is a partially cutaway diagrammatic perspective view of the FIG. 1 embodiment.

With reference to FIGS. 1 to 5, the Venturi ejector of the invention, given overall reference 1, extends along a central axis Oy. The ejector 1 comprises a feed block 10 and a suction block 20 mounted respectively in a first housing 30 receiving a first mixer body 31 and in a second housing 40 receiving a second mixer body 41. Eight tubular spacers 50.1 to 50.8 distributed at 45° from one another around a circle 51 extend between the first mixer body 31 and the second mixer body 41, holding them spaced apart from each other by a distance d. The feed and suction blocks 10 and 20, the first and second mixer bodies 31 and 41, and the tubular spacers 50.1 to 50.8 are assembled together by adhesive, using adhesives of the Araldite or cyanoacrylate type.

Figure 3:
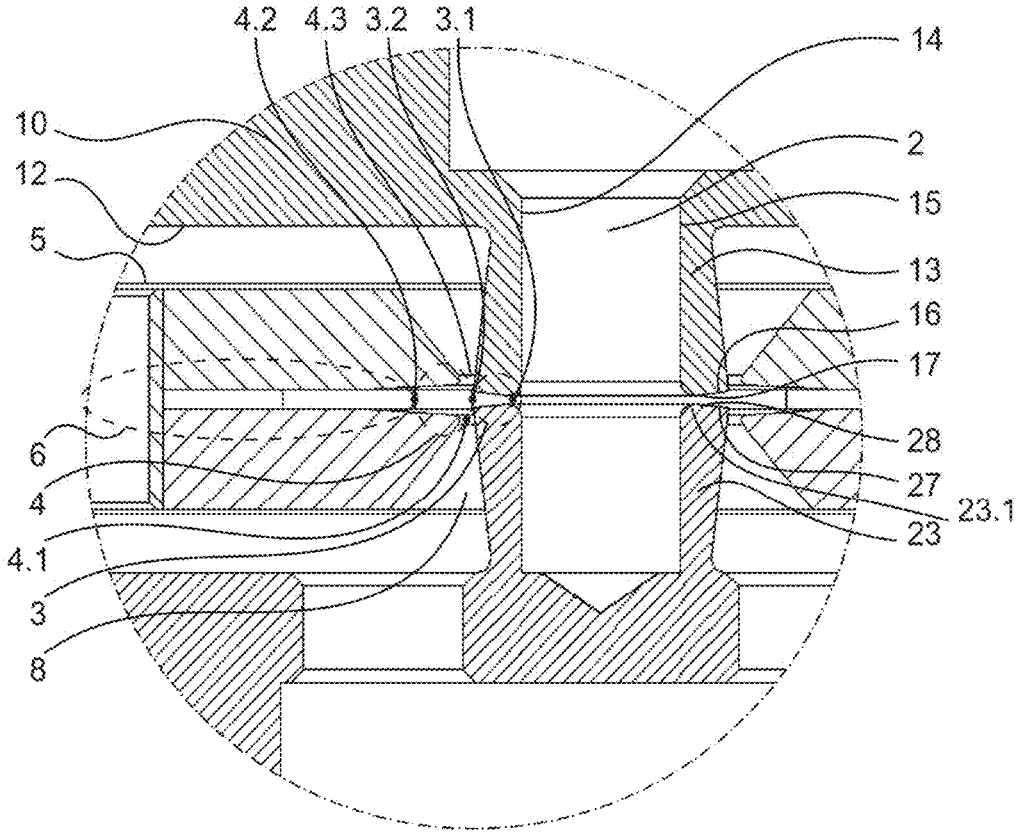
FIG. 3 is a fragmentary detail view of FIG. 1.

The feed block 10 is a cylinder having its axis coinciding with the central axis Oy, and it has a top face 11 and a bottom face 12 having at its center a tubular cylindrical feed portion 13 projecting along the central axis Oy. A bore 14 in the form of a right cylinder of central axis Oy connects the top face 11 of the feed block 10 to the inside volume 15 of the tubular feed portion 13. The bore 14 passes through the feed block 10 and puts the volumes lying beside the top face 11 and the bottom face 12 of the feed block 10 into fluid-flow connection with each other. As can be seen in FIG. 3, the bottom end 16 of the tubular portion 13 has an outer chamfer 17.

The suction block 20 is a cylinder having its axis coinciding with the central axis Oy, and it has a top face 21 and a bottom face 22. A cylindrical blind tubular portion 23 extends along the central axis Oy, projecting from the top face 21 of the suction block 20. A right cylindrical wall 24 projects along the central axis Oy from the bottom face 22 of the suction block 20, and it defines an inside volume 25. Four suction channels 26 extend parallel to the central axis Oy, being distributed at 90° from one another around the central axis Oy, and they connect the top face 21 of the suction block 20 to the inside volume 25 of the suction block 20. The suction channels 26 thus pass through the suction block 20 in order to put the volumes defined by the top face 21 and the inside volume 25 into fluid-flow connection with each other. As can be seen in FIG. 3, the top end 23.1 of the tubular portion 23 has an outer chamfer 28.

The first mixer body 31 is substantially in the form of a disk having its axis coinciding with the central axis Oy. The first mixer body 31 has a first continuous peripheral rim 32 projecting axially from its top face 33. The first rim 32 defines the first housing 30 that receives the feed block 10. The first mixer body 31 includes a central frustoconical hole 34 connecting together the top face 33 and the bottom face 35 of the first mixer body 31, the greatest diameter $D_{34}$ of the frustoconical hole 34 extending level with the top face 33 of the first mixer body 31, and the smallest diameter $d_{34}$ of the frustoconical hole 34 extending level with the bottom face 35 of the first mixer body 31.

The second mixer body 41 is substantially in the form of a disk having its axis coinciding with the central axis Oy. The second mixer body 41 has a second continuous peripheral rim 42 projecting axially from its bottom face 43. The second rim 42 defines the second housing 40 for receiving the suction block 20. The second mixer body 41 includes a central frustoconical hole 44 connecting together the top face 45 and the bottom face 43 of the second mixer body 41, the greatest diameter $D_{44}$ of the hole 44 extending level with the bottom face 43 of the second mixer body 41, and the smallest diameter $d_{44}$ of the frustoconical hole 44 extending level with the top face 45 of the second mixer body 41.

The spacers 50.1 to 50.8 are tubular right cylinders having their axes parallel to the central axis Oy. The spacers 50.1 to 50.8 are respectively engaged firstly in holes 36.1 to 36.8 in the first mixer body 31 and secondly in holes 46.1 to 46.8 in the second mixer body 41.

Together with the volume 15, the volume defined by the bore 14 defines a feed duct 2 for feeding compressed air to the ejector 1. The feed duct 2 is thus a cylindrical volume of central axis Oy. Together with the top face 45 of the second mixer body 41 and the respective bottom and top ends 16 and 23.1 of the tubular portion 13 and of the blind tubular portion 23, the bottom face 35 of the first mixer body 31 defines the following annular chambers:

- a first expansion chamber 3 defined by the two non-touching ends of the respective bottom and top ends 16 and 23.1 of the tubular portion 13 and of the blind tubular portion 23. The first expansion chamber 3 has a first fluid inlet 3.1 in the form of a free right cylindrical section extending between the feed duct 2 and the blind tubular portion 23;
- a first mixing chamber 4 connected to a fluid outlet 3.2 of the first expansion chamber 3;
- a first suction chamber 5 connected to a first suction port 4.1 of the mixing chamber 4;
- an exhaust chamber 6 connected to a first exhaust port 4.2 of the mixing chamber 4 and that communicates with an outlet port 7 of the ejector 1. In this example, the outlet port 7 corresponds to the free right cylindrical surface that is defined by the distal ends of the respective bottom and top surfaces 35 and 45 of the first and second mixer bodies 31 and 41; and
- a second suction chamber 8 connected to a second suction port 4.3 of the mixing chamber 4. The tubular spacers 50.1 to 50.8 provide fluid-flow connection between the first and second suction chambers 5 and 8.

Figure 4:
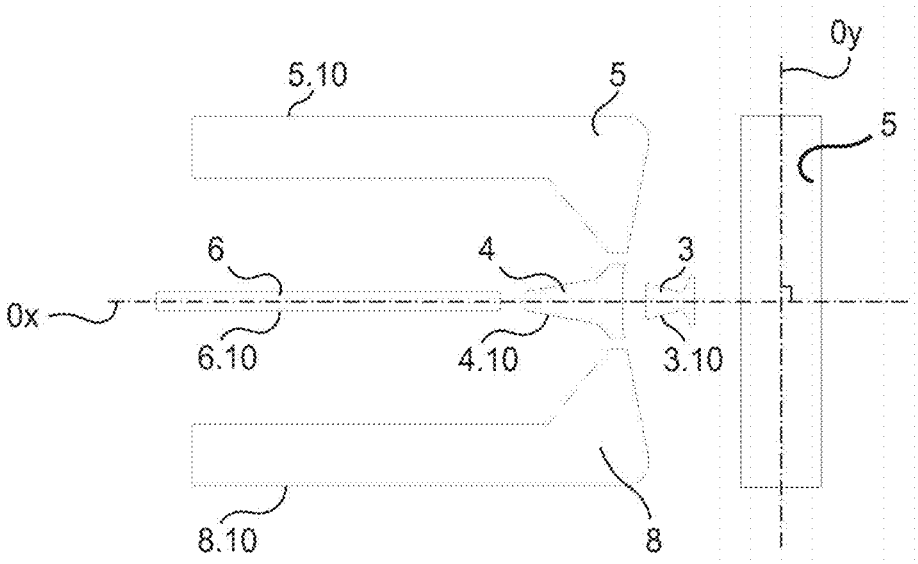
FIG. 4 is an exploded diagrammatic representation of the various chambers of the FIG. 1 embodiment.
Figure 5:
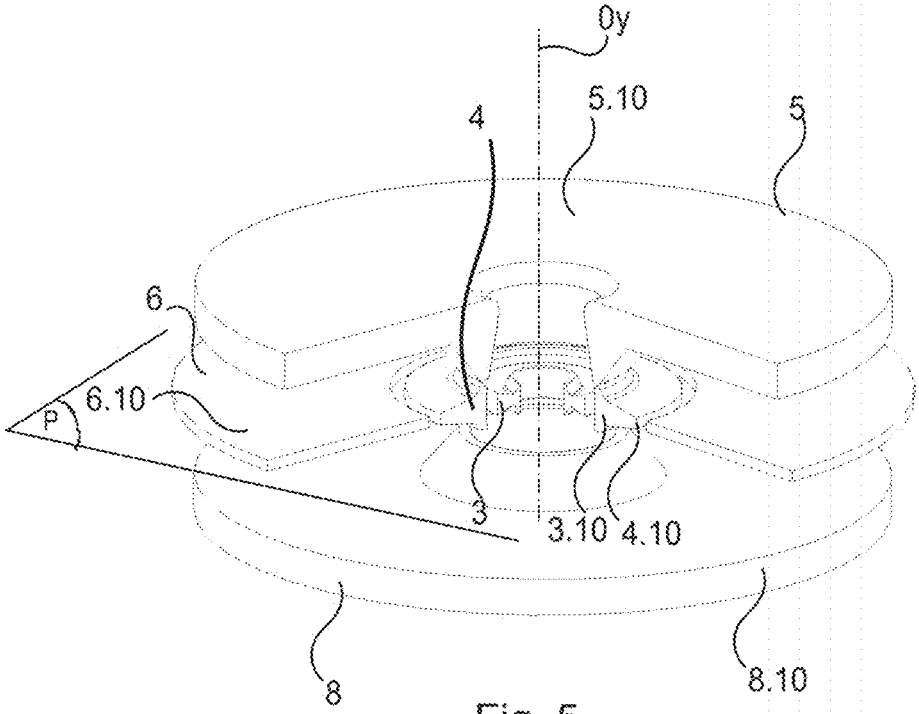
FIG. 5 is a partially cutaway diagrammatic exploded perspective view of the chambers of the FIG. 1 embodiment.

In the meaning of the present application, an annular chamber is a volume defined by rotating a closed generator curve contained in a plane about an axis that is situated in the same plane as the generator curve and that possesses no point in common therewith, or only points at its boundary. Thus, and as can be seen in FIGS. 4 and 5, the first expansion chamber 3, the first mixing chamber 4, the first suction chamber 5, the second suction chamber 8, and the exhaust chamber 6 are defined respectively by rotating a first expansion generator curve 3.10, a first mixing generator curve 4.10, a first suction generator curve 5.10, a second suction generator curve 8.10, and an exhaust generator curve 6.10 about the central axis Oy. The first expansion generator curve 3.10, the first mixing generator curve 4.10, and the exhaust generator curve 6.10 possess a common axis of symmetry Ox orthogonal to the central axis Oy. Thus, the first expansion chamber 3, the first mixing chamber 4, and the exhaust chamber 6 possess the same plane of symmetry P orthogonal to the central axis Oy and they are coaxial about the central axis Oy. As for the first and second suction chambers 5 and 8, they are symmetrical relative to the plane P.

A Venturi ejector 1 is thus obtained that comprises:

- a compressed air feed duct 2;
- a first expansion chamber 3 comprising a first compressed air inlet 3.1 connected to the feed duct 2;
- a first mixing chamber 4 connected to a first fluid outlet 3.2 of the expansion chamber 3;
- a first suction chamber 5 connected to a first suction port 4.1 of the first mixing chamber 4;
- a second suction chamber 8 connected to a second suction port 4.3 of the first mixing chamber 4; and
- an exhaust chamber 6 connected to a first exhaust port 4.2 of the first mixing chamber 4 and that communicates with an outlet port 7 of the ejector 1. By mutual engagement, the volume 25 serves to connect to a network that is to be connected to reduced pressure, e.g. such as a suction cup (not shown). The feed duct 2 extends along the central axis Oy of the ejector 1 and the first expansion chamber 3, the first mixing chamber 4, the first suction chamber 5, and the exhaust chamber 6 are annular chambers coaxial about the axis of the feed duct 2.

In operation, a vacuum generator 500 (not shown) comprises a compressed air generator 501 (not shown) connected to the feed duct 2 of the Venturi ejector 1 in order to insert compressed air into the feed duct 2 along a direction E substantially parallel to the central axis Oy. Thereafter, the compressed air penetrates into the expansion chamber 3 through the first inlet 3.1. The difference in section between the feed duct 2 and the first inlet 3.1 causes the compressed air to accelerate as it enters into the expansion chamber 3. It should be observed that the compressed air penetrates from the feed duct 2 into the expansion chamber 3 along a plurality of directions D extending over 360° in a plane that is substantially orthogonal to the central axis Oy, and thus to the direction E.

The respective outer chamfers 17 and 28 of the tubular portions 13 and 23 together with the increase in the annular section with increasing distance between the section under consideration and the axis of revolution give rise to a flow section that increases going from the first inlet 3.1 towards the first fluid outlet 3.2. The compressed air is thus subjected to expansion, thereby generating a reduction in pressure at the outlet from the expansion chamber 3. This pressure reduction creates suction at the first and second suction ports 4.1 and 4.3 respectively of the first and second suction chambers 5 and 8. The pressure in the first and second suction chambers 5 and 8 is thus reduced, and this pressure reduction is communicated from the second suction chamber 8 to the first suction chamber 5 via the spacers 50.1 to 50.8. The channels 26 thus cause the pressure in the volume 25 to be reduced. Thus, a network of handling suction cups that is to be connected to reduced pressure and that is connected to the chamber 25 receives the reduced pressure necessary for generating suction in the network of suction cups.

The Venturi ejector 1 of the invention is more compact than prior art ejectors and has also been found to be remarkably less noisy, to such an extent that it appears to be unnecessary to make use of a silencer, thereby further reducing the overall size of the ejector of the invention.

Elements that are identical or analogous to those described above are given the same references plus 100 in the description below of the second embodiment, plus 200 in the description below of the third embodiment, plus 300 in the description below of the fourth embodiment, and plus 400 in the description below of the fifth embodiment.

Figure 6:
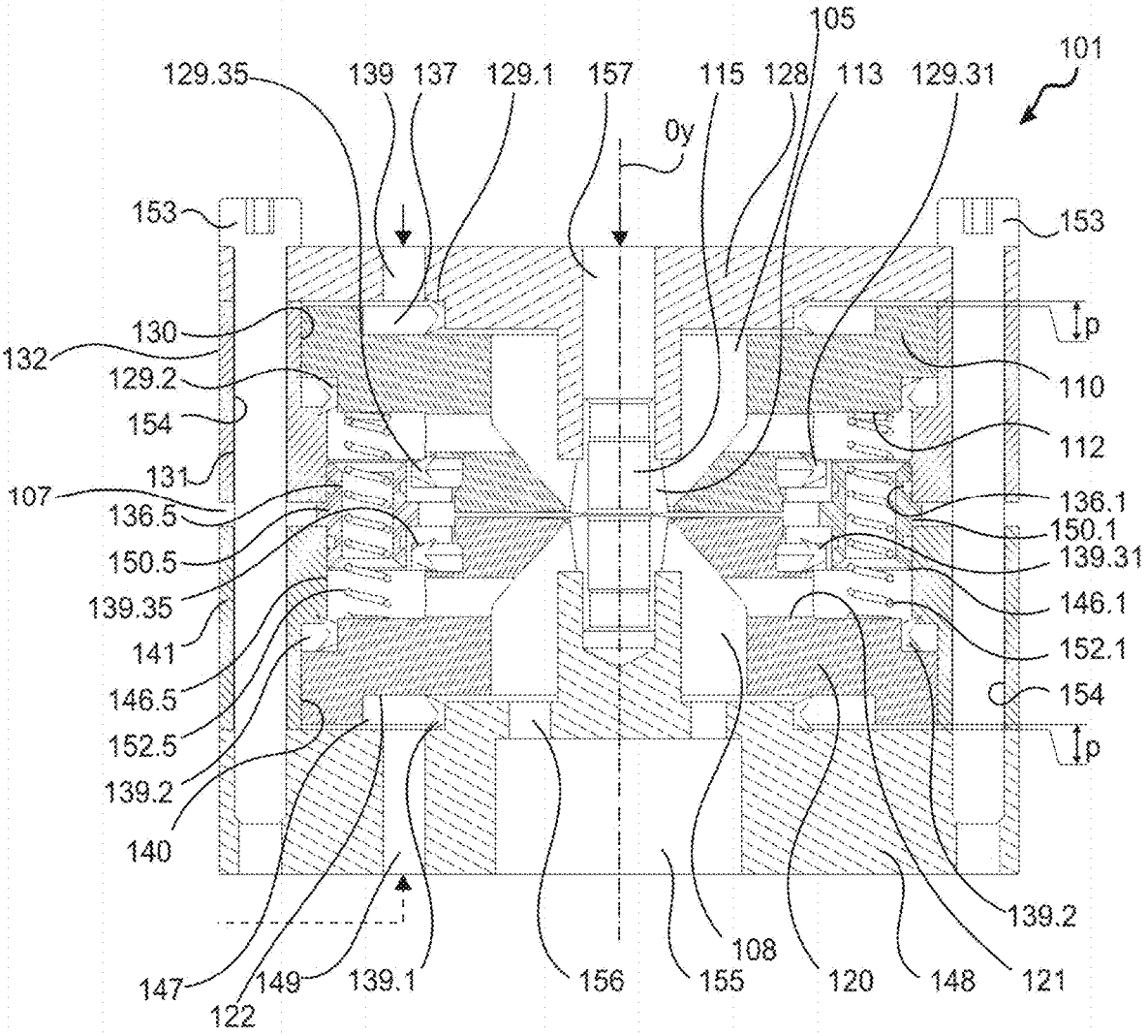
FIG. 6 is a diagrammatic section view of a second embodiment of the ejector of the invention.
Figure 7:
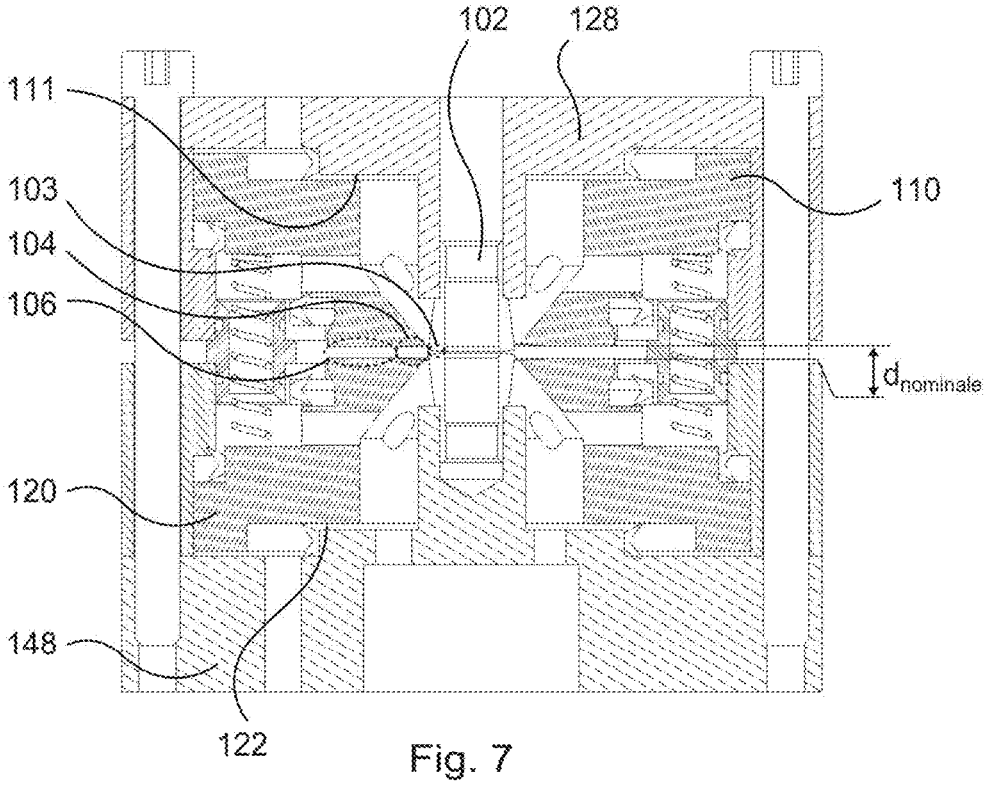
FIG. 7 is a view identical to the view of FIG. 6 showing the ejector of the invention in a first configuration.
Figure 8:
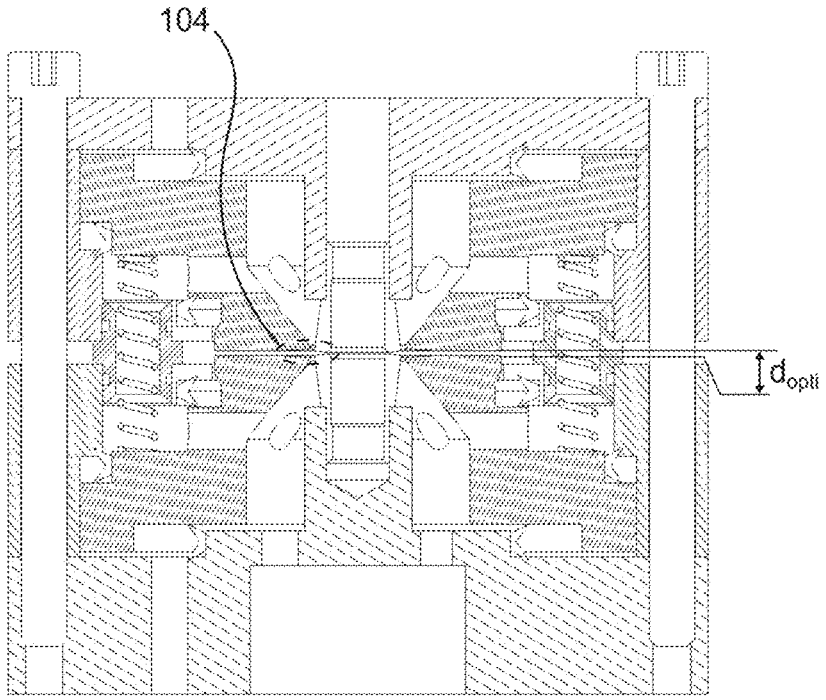
FIG. 8 is a view identical to the view of FIG. 6 showing the ejector of the invention in a second configuration.

With reference to FIGS. 6 to 8, the Venturi ejector 101 in the second embodiment extends along a central axis Oy and comprises a feed block 110 and a suction block 120 mounted respectively in a first housing 130 of a first mixer body 131 and in a second housing 140 of a second mixer body 141. A top cover 128 and a bottom cover 148 extend at a certain distance p respectively from the top face 111 of the feed block 110 and from the bottom face 122 of the suction block 120. Together with the top face 111 of the feed block 110 and the first rim 132 of the first mixer body 131, the top cover 128 defines a first pilot chamber 137. Together with the bottom face 122 of the suction block 120 and the second rim 142 of the second mixer body 141, the bottom cover 148 defines a second pilot chamber 147. The top cover 128 and the bottom cover 148 include respective tapped holes 139 and 149 constituting pilot pressure feed ports respectively for the first pilot chamber 137 and for the second pilot chamber 147, said ports being connected in this example to the atmosphere.

Eight tubular spacers 150.1 to 150.8 are respectively engaged firstly in holes 136.1 to 136.8 in the first mixer body 131 and secondly in holes 146.1 to 146.8 in the second mixer body 141. Eight helical springs 152.1 to 152.8 extend inside the tubular spacers between the bottom surface 112 of the feed block 110 and the top surface 121 of the suction block 120.

Sealing gaskets—lip seals in this example—129.1, 129.2 and 129.31 to 129.38 serve to seal the feed block 110 respectively with the top cover 128, with the rim 132, and with the top end of each spacer 150.1 to 150.8. Corresponding gaskets 139.1, 139.2, and 139.31 to 139.38 serve to seal the suction block 120 respectively with the bottom cover 148, with the rim 142, and with the bottom end of each spacer 150.1 to 150.8.

Six screws 153 extend in peripheral holes 154 made in the rims 132 and 142 respectively of the first mixer body 131 and of the second mixer body 141, and they connect the top cover 128 to the bottom cover 148. The feed and suction blocks 110 and 120 are mounted to slide respectively in the first housing 130 and in the second housing 140. As can be seen particularly in FIG. 6, the feed and suction blocks 110 and 120 are identical and mounted with specular symmetry (i.e. mirror-image symmetry) relative to each other. The second suction chamber 108 is connected to a volume 155 of the bottom cover 148 by channels 156. This volume 155 serves to connect the ejector 101 to a network that is to be connected to reduced pressure. As for the inside volume 115 of the tubular portion 113, it is connected to a bore in the top cover 128 and constitutes a feed port 157 for feeding compressed air to the ejector 101.

In operation, and prior to inserting compressed air into the feed port 157, the first and second pilot chambers 137 and 147 are at atmospheric pressure, as are the suction chambers 105 and 108. The springs 152.1 to 152.8 push apart the feed and suction blocks 110 and 120 so that the top face 111 of the feed block 110 and the bottom face 122 of the suction block 148 are in contact respectively with the top cover 128 and with the bottom cover 148. The distance d between the bottom face 135 of the feed block 110 and the top face 145 of the suction block 120 is then equal to $d_{nominale}$ (FIG. 7). When compressed air is inserted into the feed port 157, the flow rate sucked into the volume 155 is large for a low vacuum level. As the vacuum level varies (i.e. as the absolute pressure in the volume 155 approaches 0 bar, e.g. under the effect of the volume 155 being partially obstructed by an object that is to be handled), the pressure that obtains in the first and second suction chambers 105 and 108 decreases, thereby causing the feed blocks 110 and 120 to move towards each other under the effect of the pilot pressure that obtains in the first and second pilot chambers 137 and 147. Specifically, the pilot pressure exerts a force urging the feed and suction blocks 110 and 120 to move towards each other against the force exerted by the springs 152.1 to 152.8 plus the force resulting from the pressure that obtains in the first and second feed chambers 105 and 108 acting on the bottom face 112 of the feed block 110 and on the bottom face of the suction block 120. With the pressure that obtains in the first and second feed chambers 105 and 108 decreasing, the distance d between the feed and suction blocks 110 and 120 decreases from the value $d_{nominale}$ to a value $d_{opti}$ corresponding to the optimum value for the Venturi profile of the ejector in which the degree of vacuum is optimal. It can clearly be seen in FIGS. 7 and 8 that the volume of the first mixing chamber 104 varies as a function of the distance d.

Since the pilot pressure is constant (equal to atmospheric pressure), it is the dimensioning of the springs 152.1 to 152.8 that defines the extent to which the feed and suction blocks 110 and 120 move towards each other or apart as a function of the degree of vacuum that obtains in the suction chambers 105 and 108. The degree of vacuum is calculated by subtracting the pressure in the suction chambers from ambient pressure and by dividing the resulting value by ambient pressure. The degree of vacuum is representative of the suction created.

An ejector 101 is thus obtained in which the volume of the first mixing chamber 104 can be controlled in order to improve the performance of the ejector 101 in terms of flow rate or in terms of degree of vacuum. The first expansion chamber 103 and the first mixing chamber 104 are annular chambers coaxial about the axis of the feed duct 102.

Figure 9:
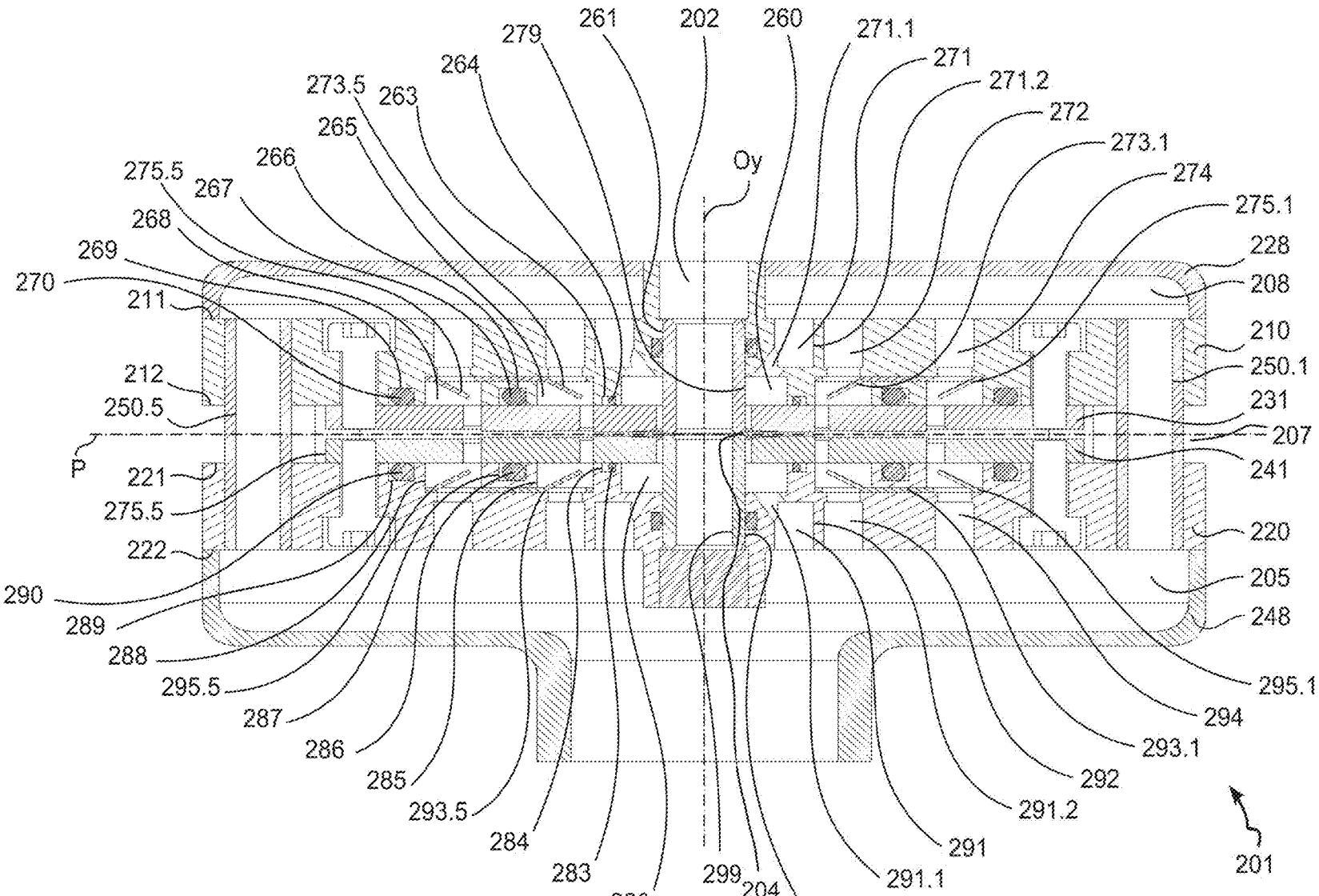
FIG. 9 is a diagrammatic section view of a third embodiment of the ejector of the invention.
Figure 10:
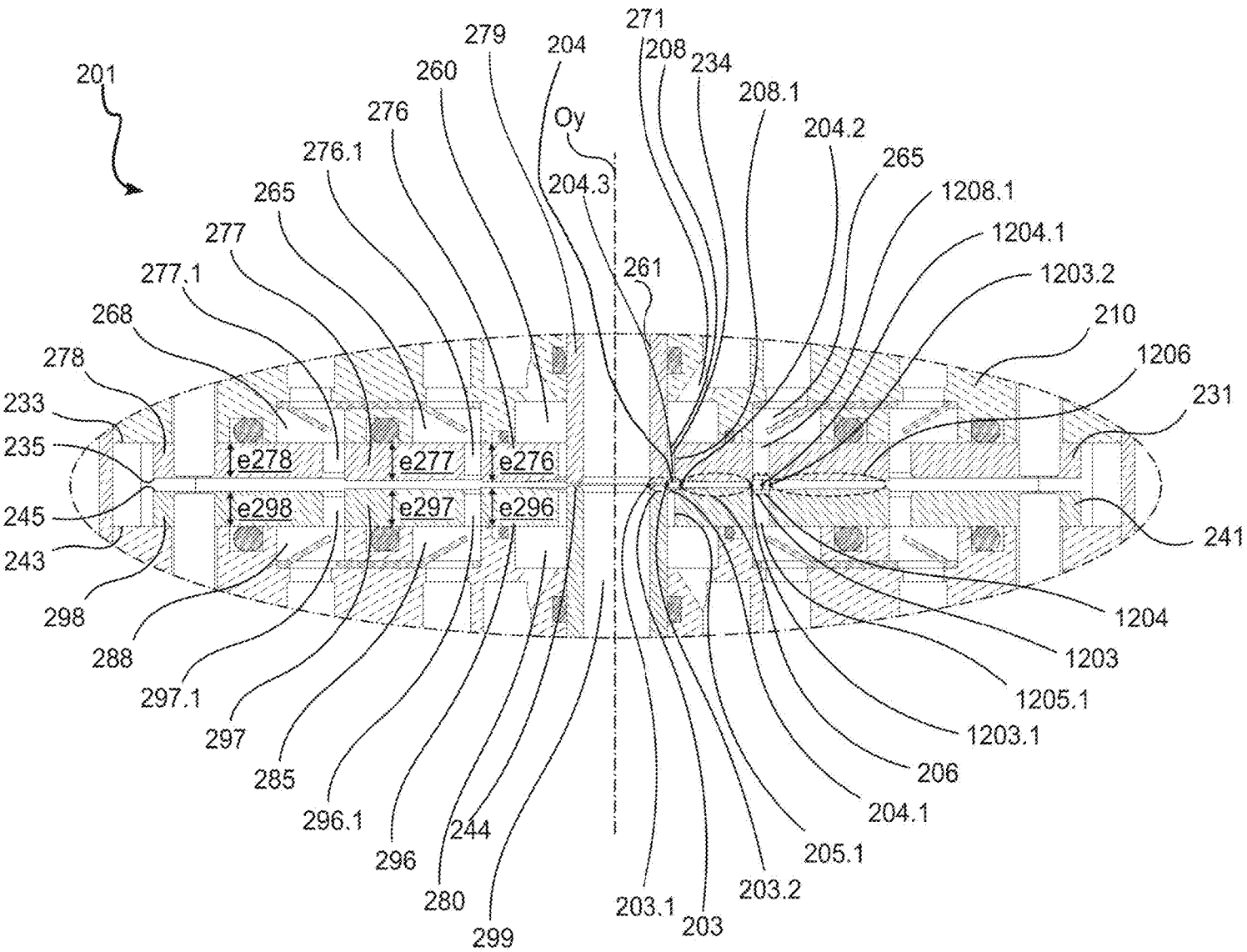
FIG. 10 is a fragmentary detail view of FIG. 9.
Figure 11:
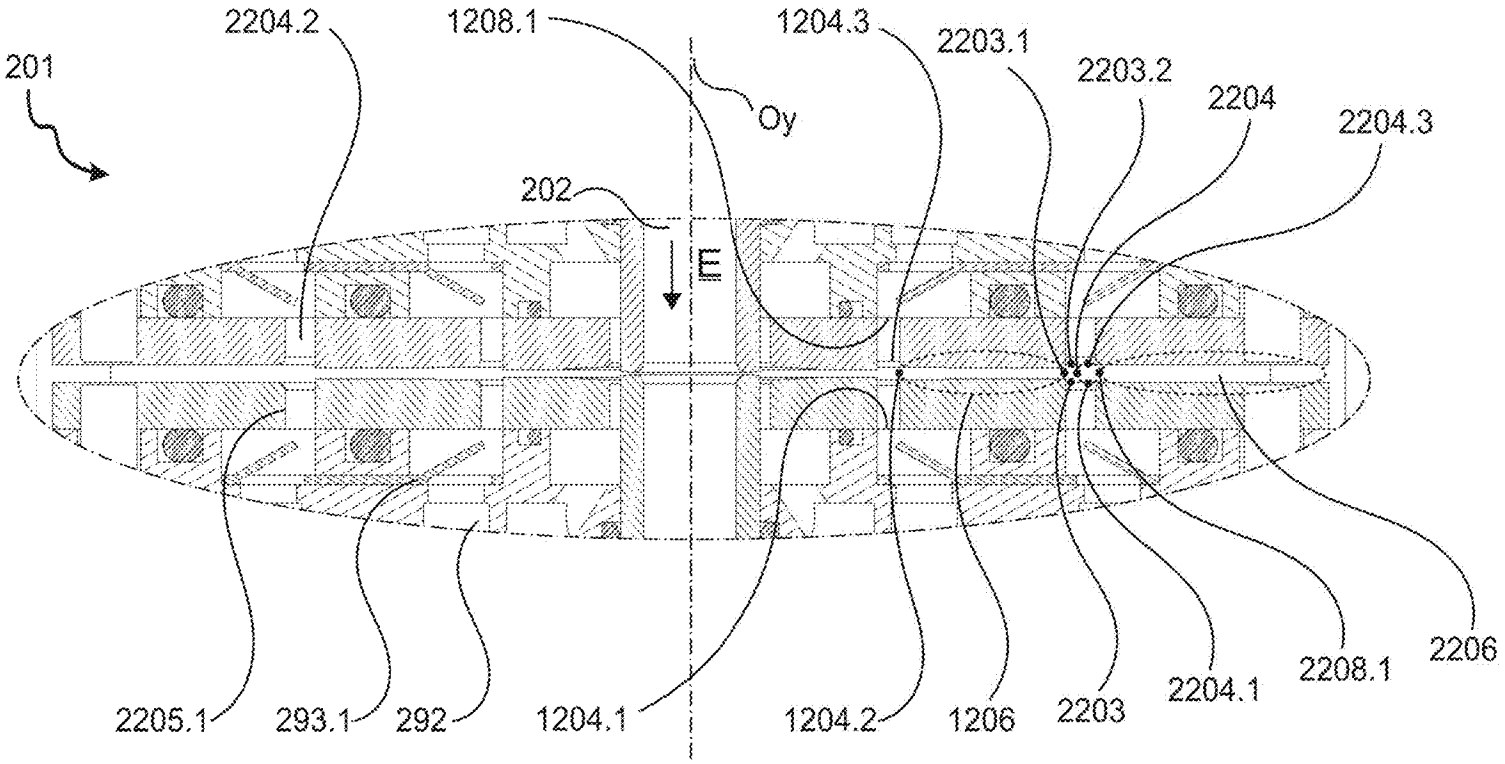
FIG. 11 is a view identical to the view of FIG. 10.
Figure 12:
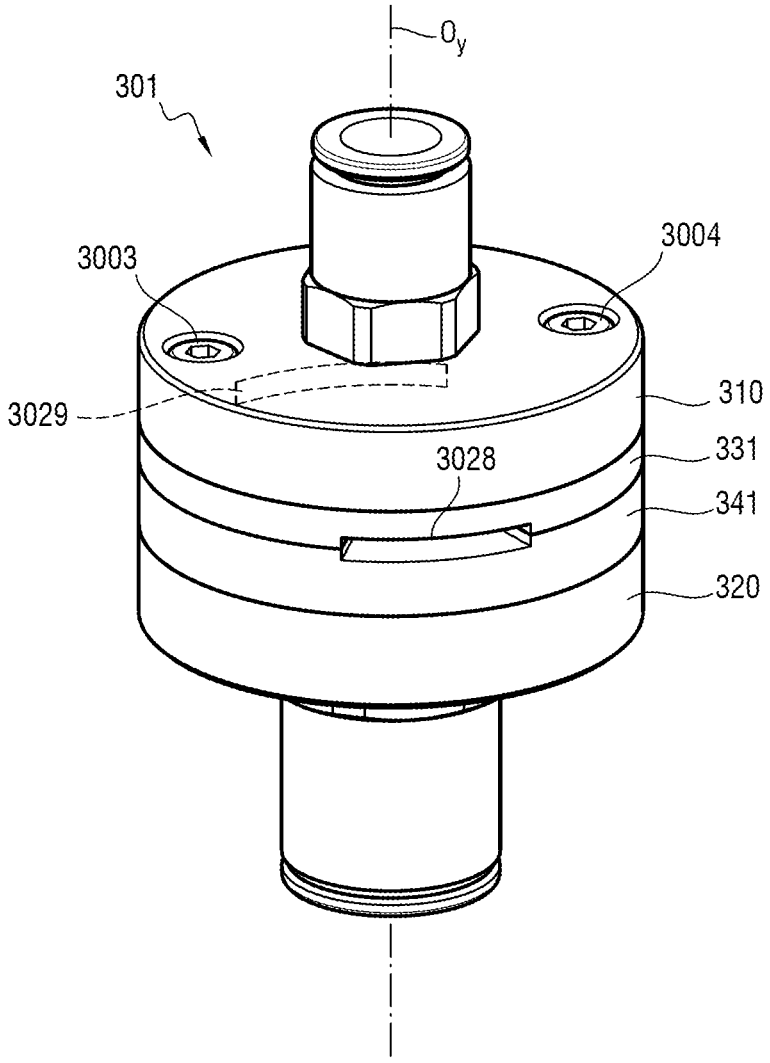
FIG. 12 is a perspective view of a fourth embodiment of the ejector of the invention.
Figure 13:
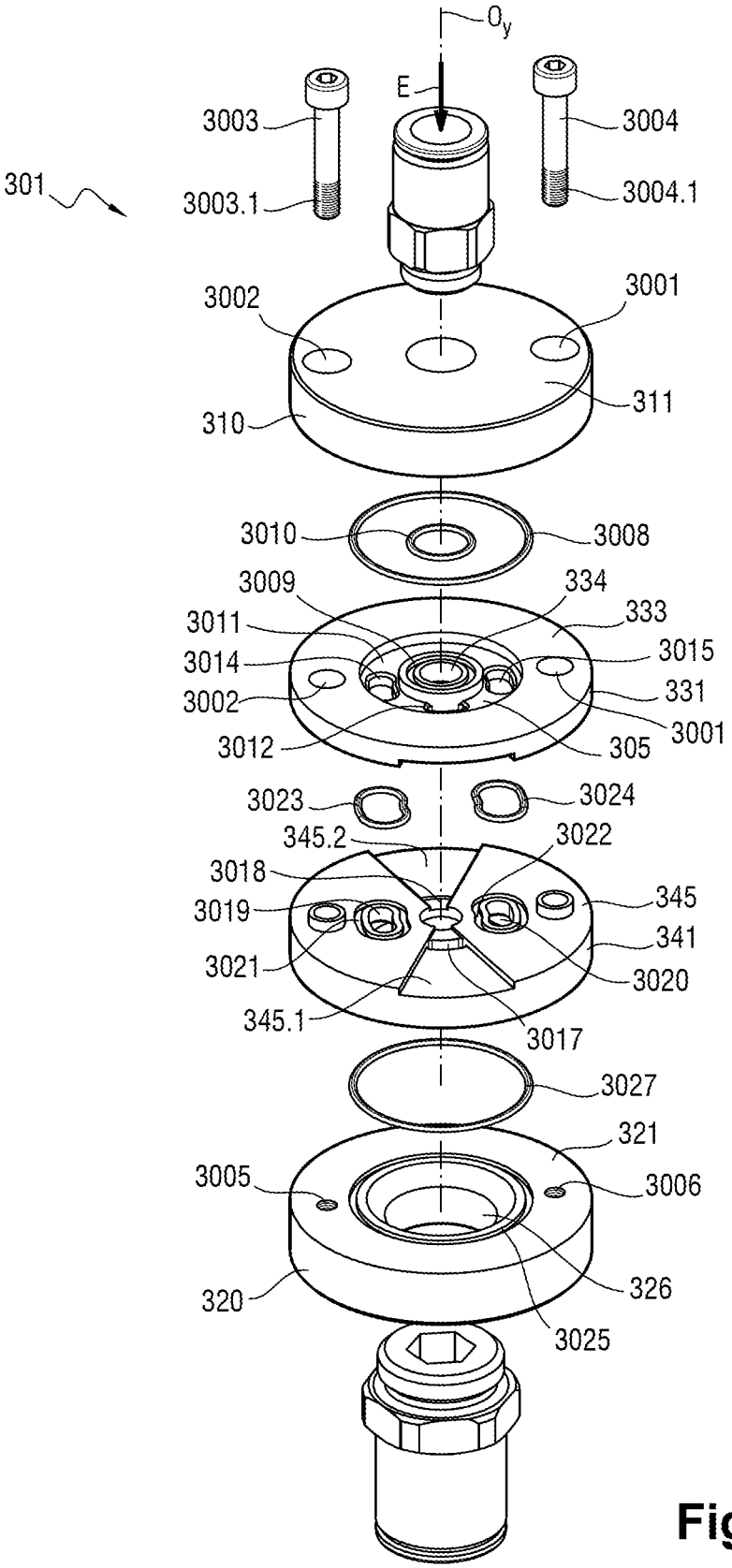
FIG. 13 is an exploded perspective view of the FIG. 12 embodiment seen from a first angle.
Figure 14:
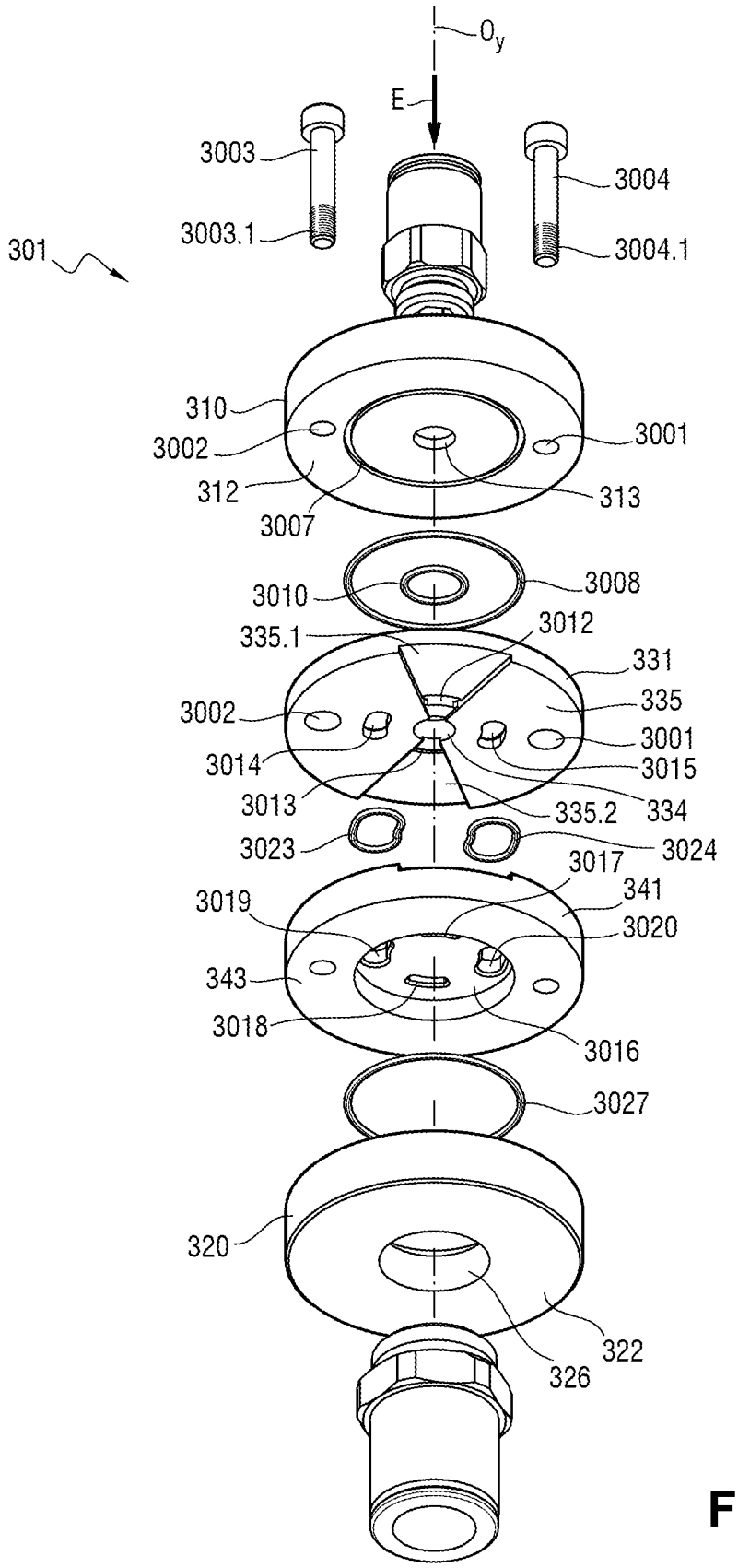
FIG. 14 is an exploded perspective view of the FIG. 12 embodiment seen from a second angle.
Figure 15A:
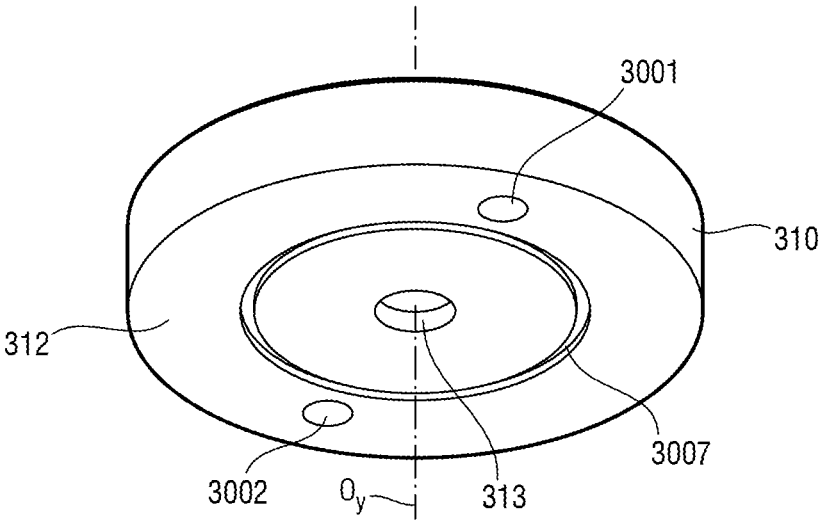
FIGS. 15*a* and 15*b* are perspective views of a feed block of the fourth embodiment of the invention.
Figure 15B:
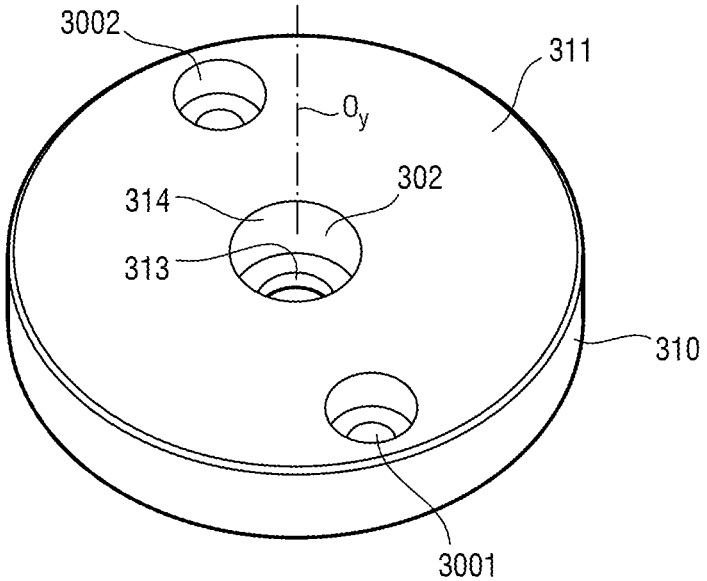
Figure 15C:
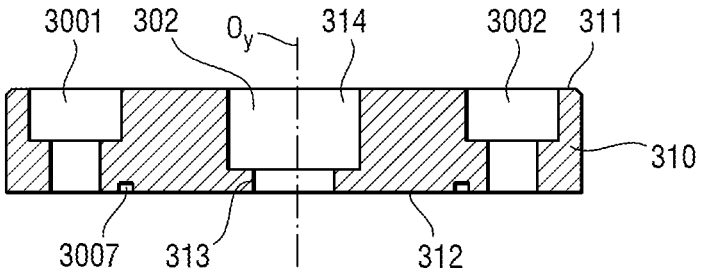
FIG. 15*c* is a longitudinal section view of the feed block of FIGS. 15*a* and 15*b;*
Figure 16A:
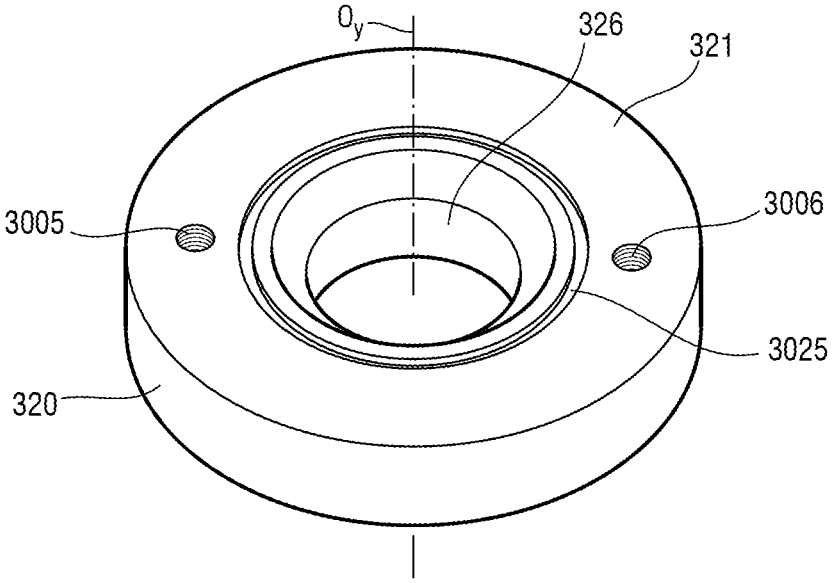
FIGS. 16*a* and 16*b* are perspective views of a suction block of the fourth embodiment of the invention.
Figure 16B:
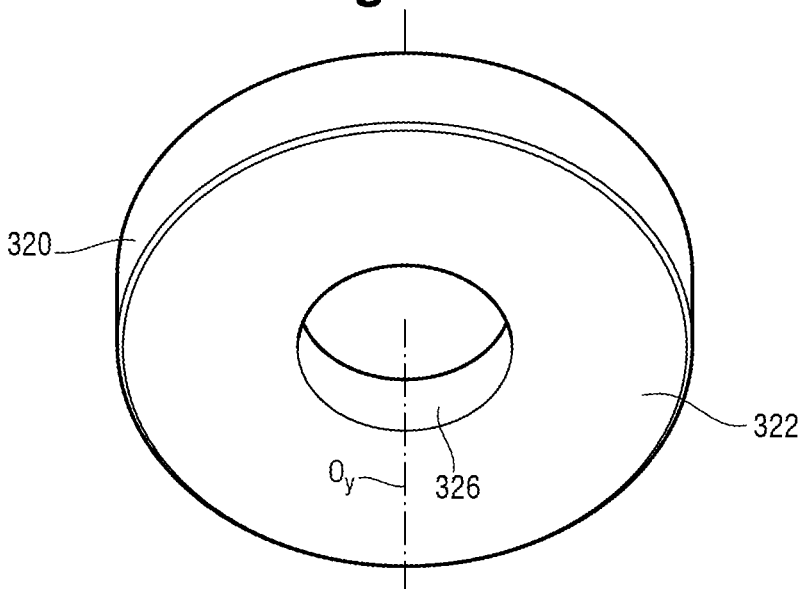
Figure 16C:
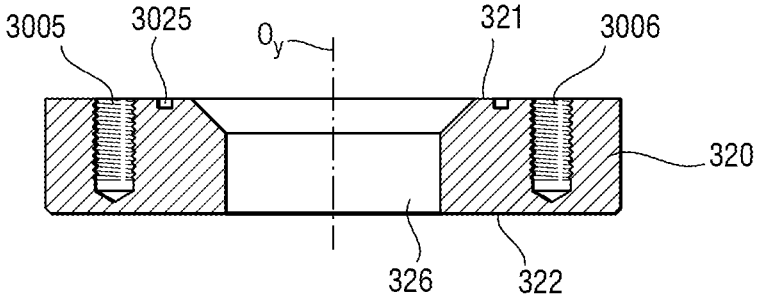
FIG. 16*c* is a longitudinal section view of the suction block of FIGS. 16*a* and 16*b;*
Figure 17A:
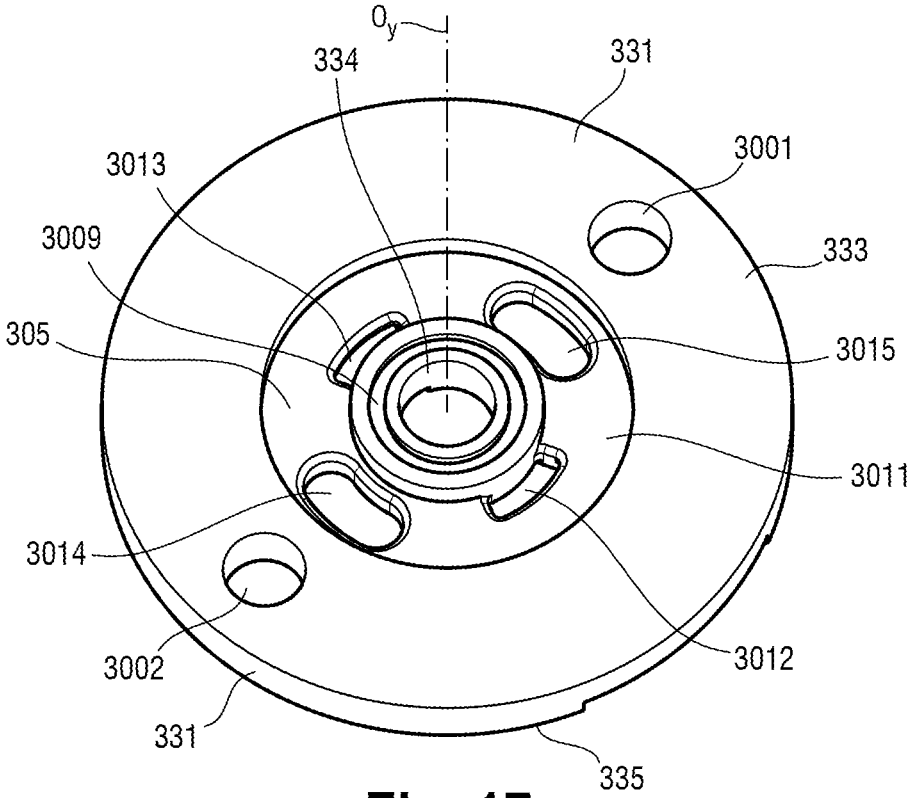
FIGS. 17*a* and 17*b* are perspective views of a first mixer body in the fourth embodiment of the invention.
Figure 17B:
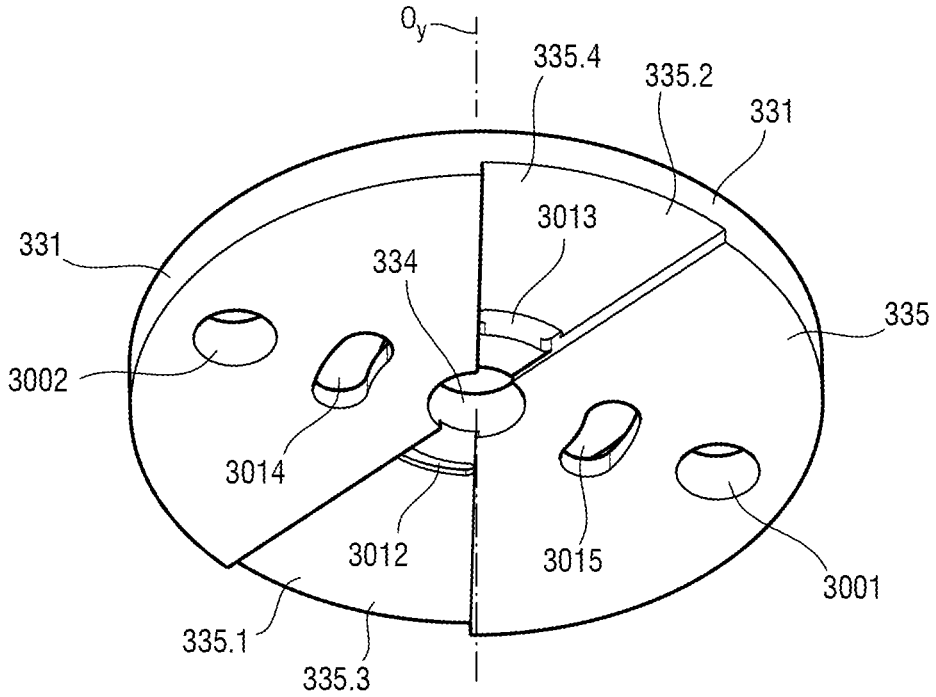
Figure 18A:
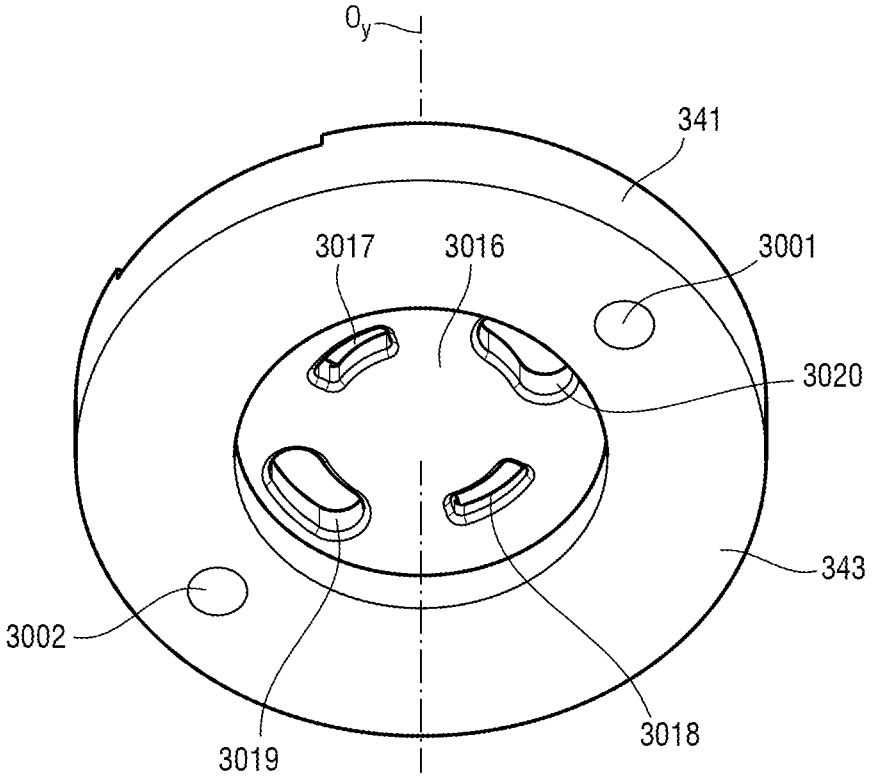
FIGS. 18*a* and 18*b* are perspective views of a first mixer body in the fourth embodiment of the invention.
Figure 18B:
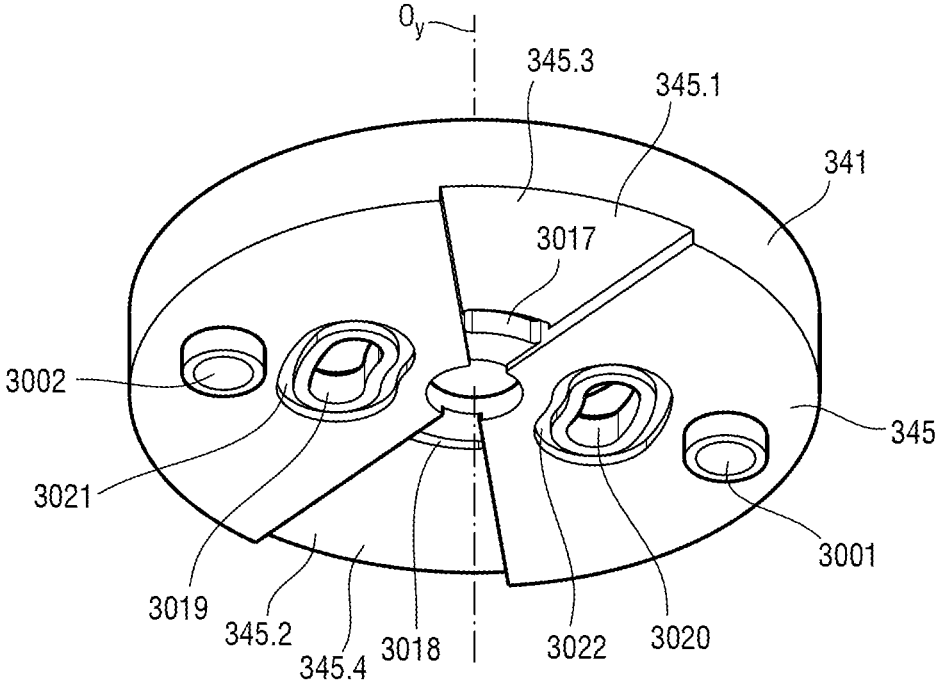
Figure 19:
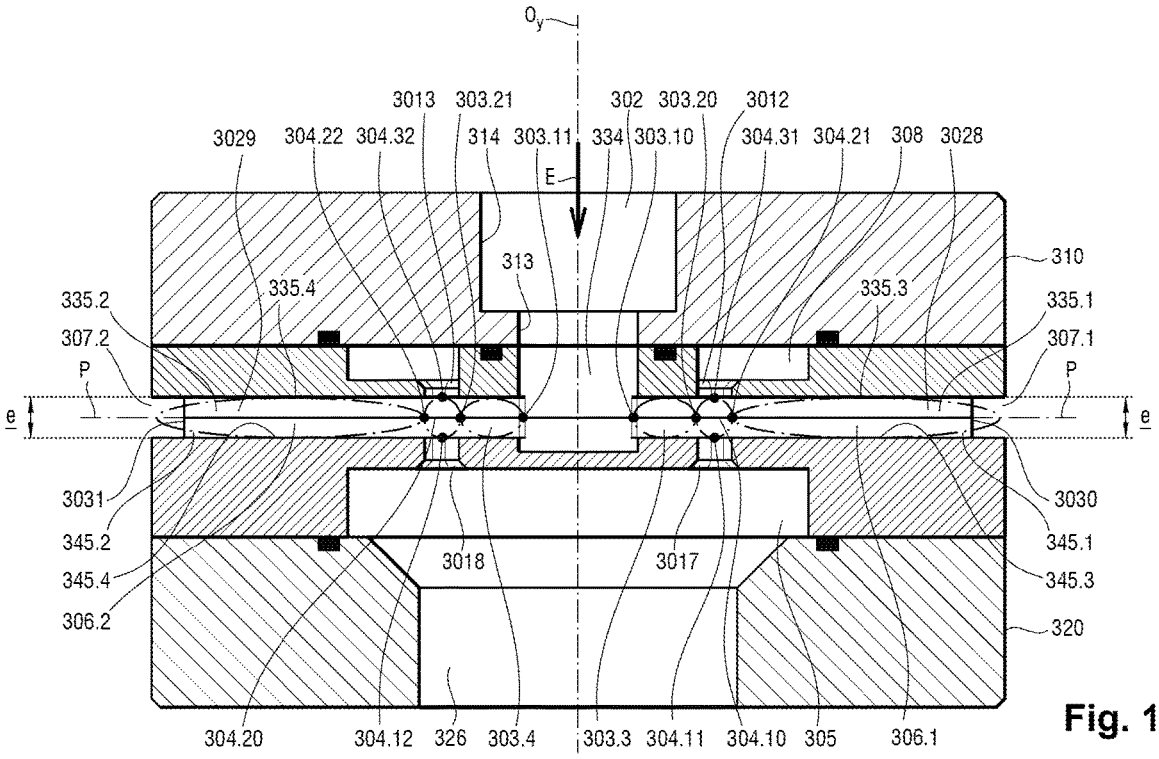
FIG. 19 is a longitudinal section view of the FIG. 12 ejector.
Figure 20:
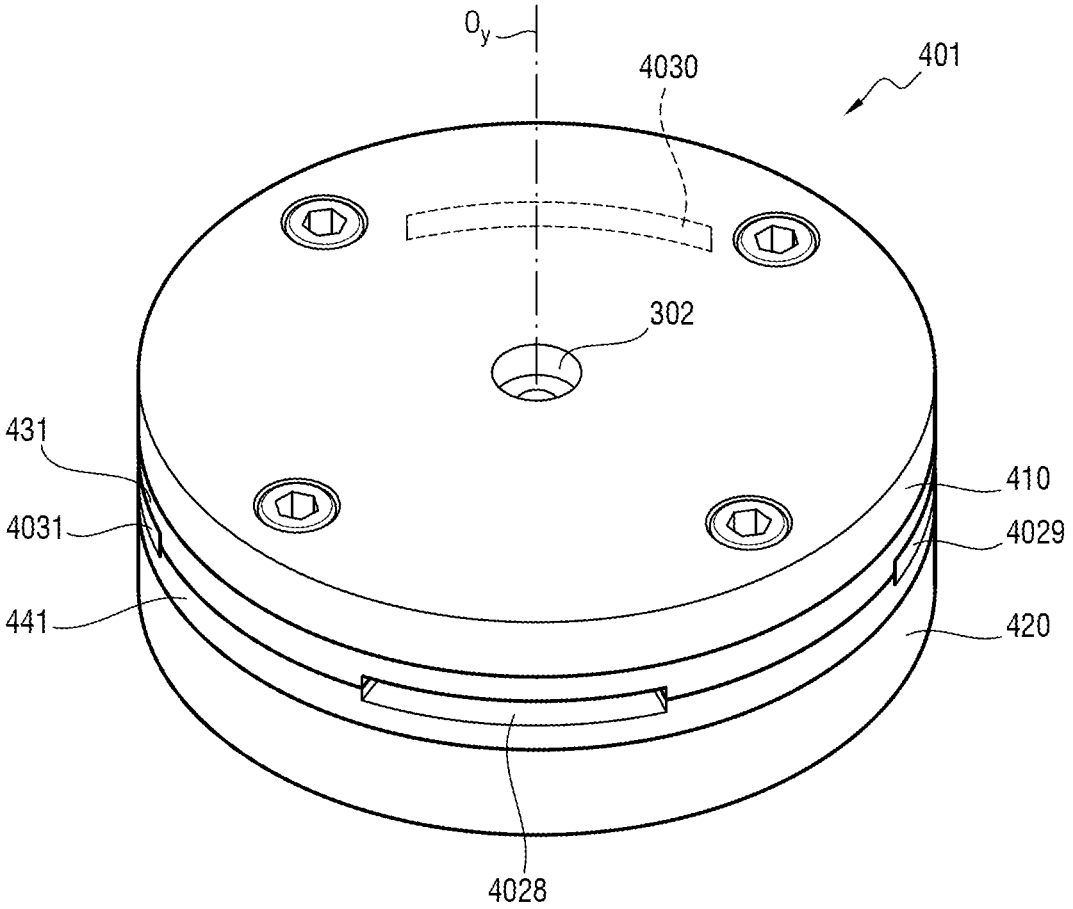
FIG. 20 is a perspective view of a fifth embodiment of the ejector of the invention.
Figure 21:
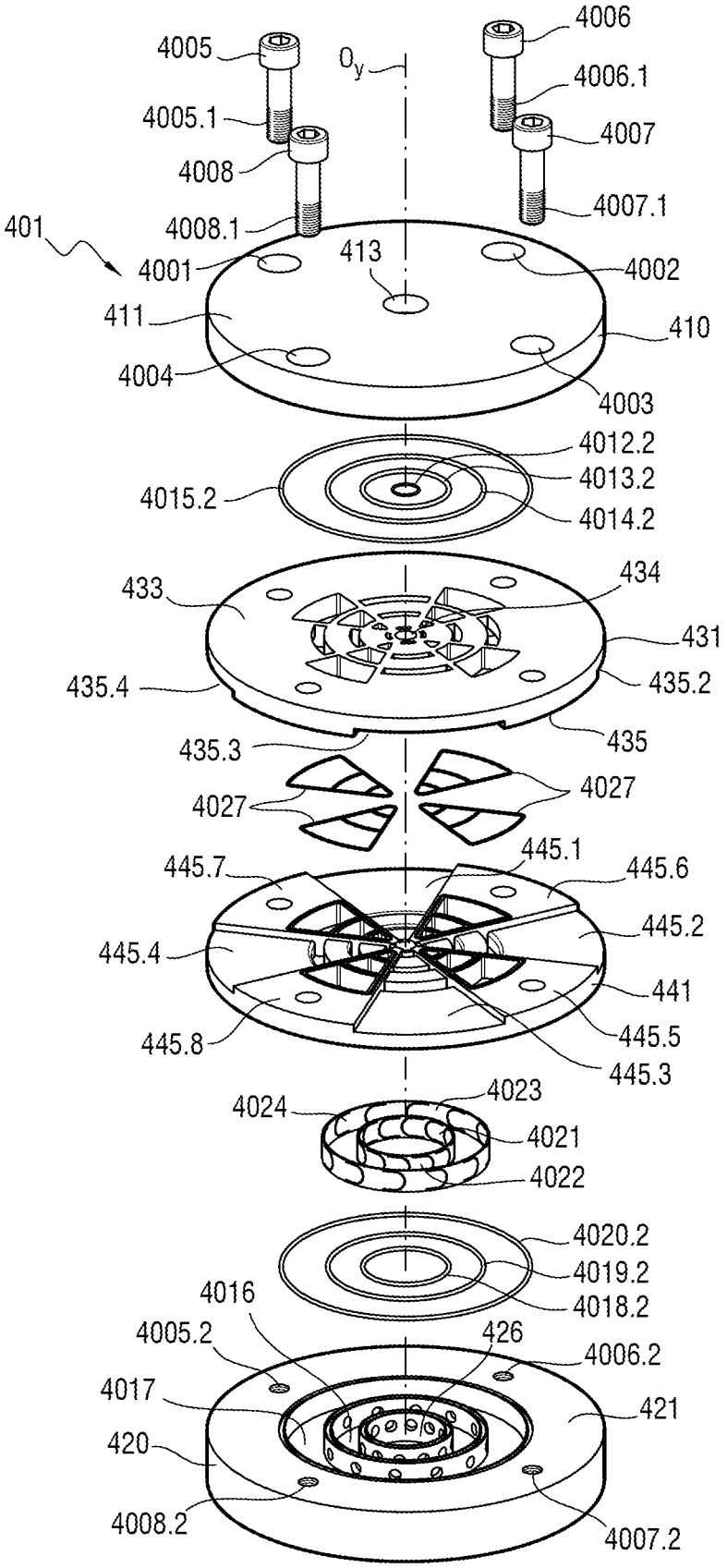
FIG. 21 is an exploded perspective view of the FIG. 20 embodiment seen from a first angle.
Figure 22:
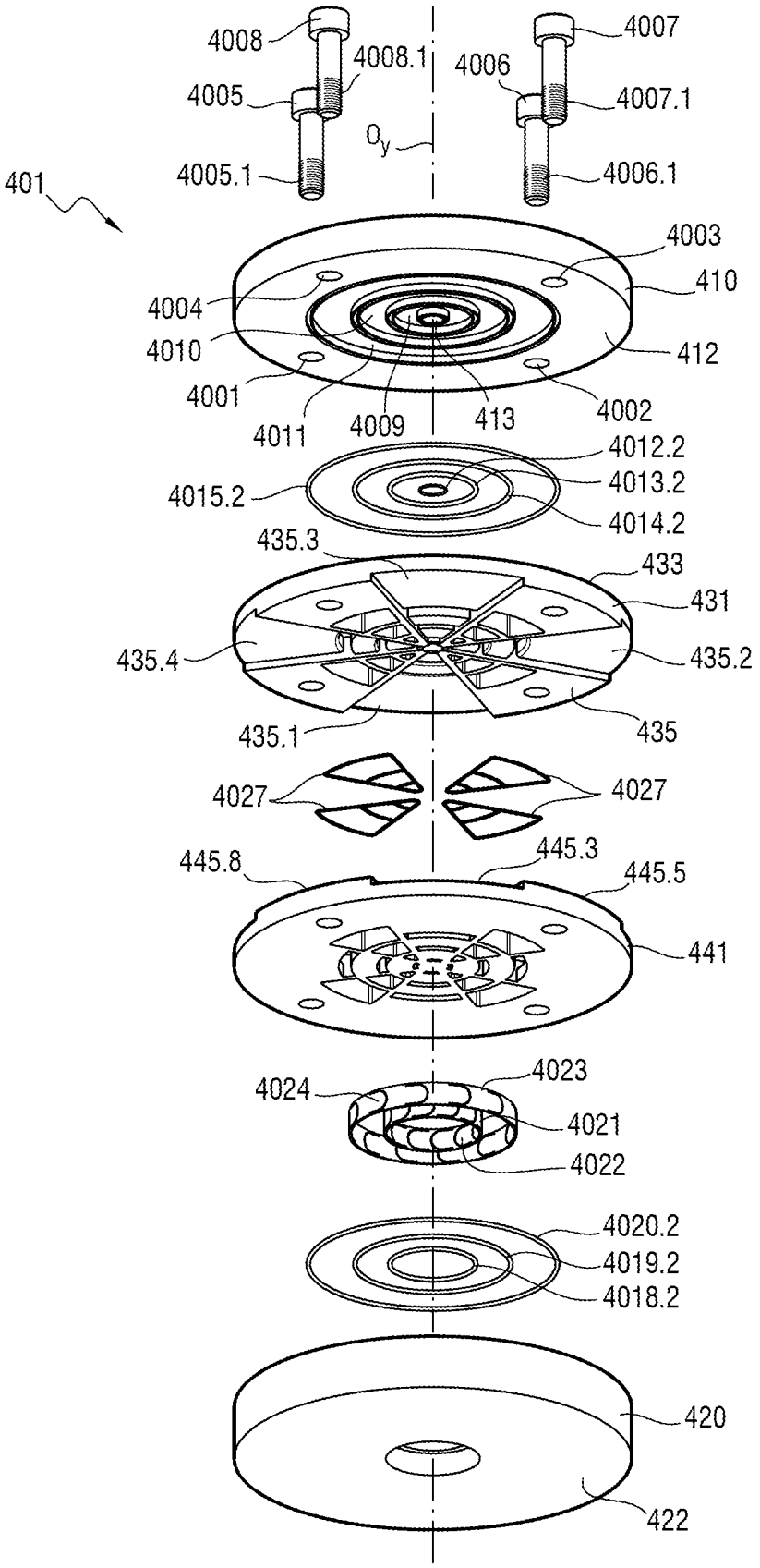
FIG. 22 is an exploded perspective view of the FIG. 12 embodiment seen from a second angle.
Figure 23:
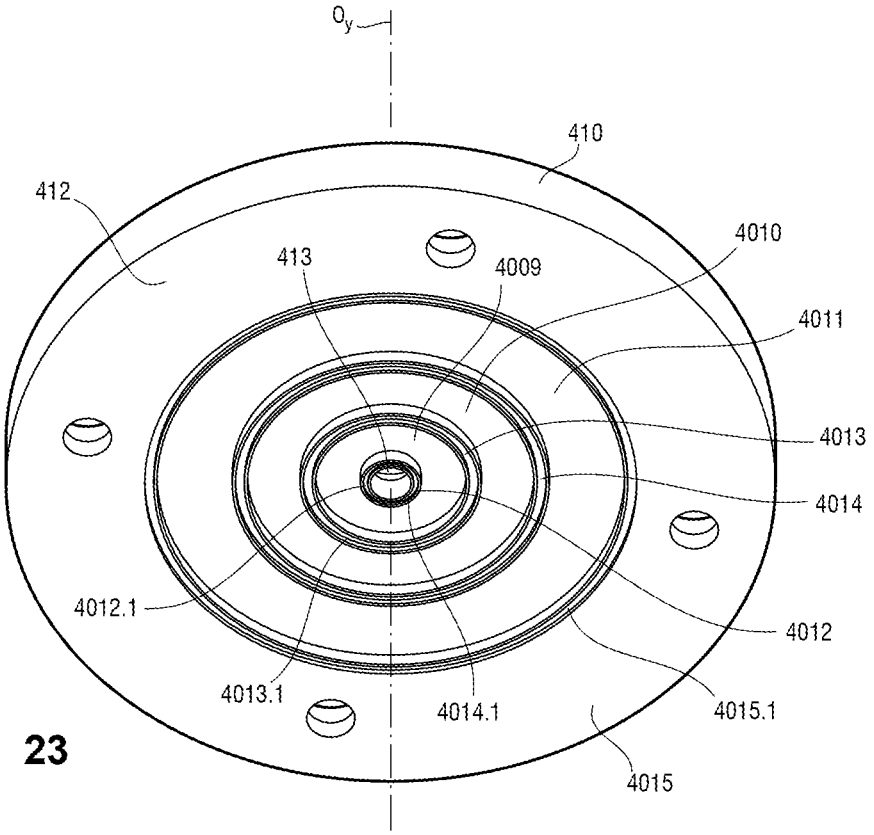
FIG. 23 is a perspective view of a feed block in the fifth embodiment of the invention.
Figure 24:
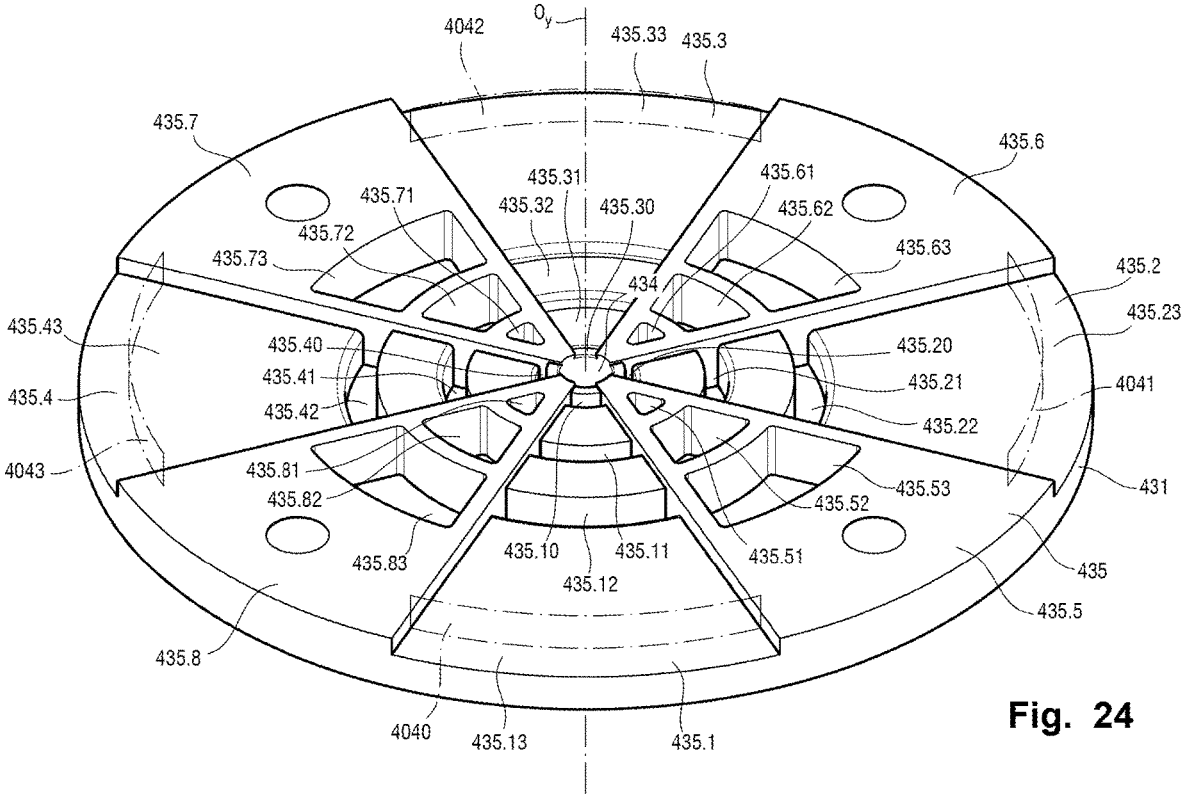
FIGS. 24 and 25 are perspective views of a first mixer body in the fifth embodiment of the invention.
Figure 25:
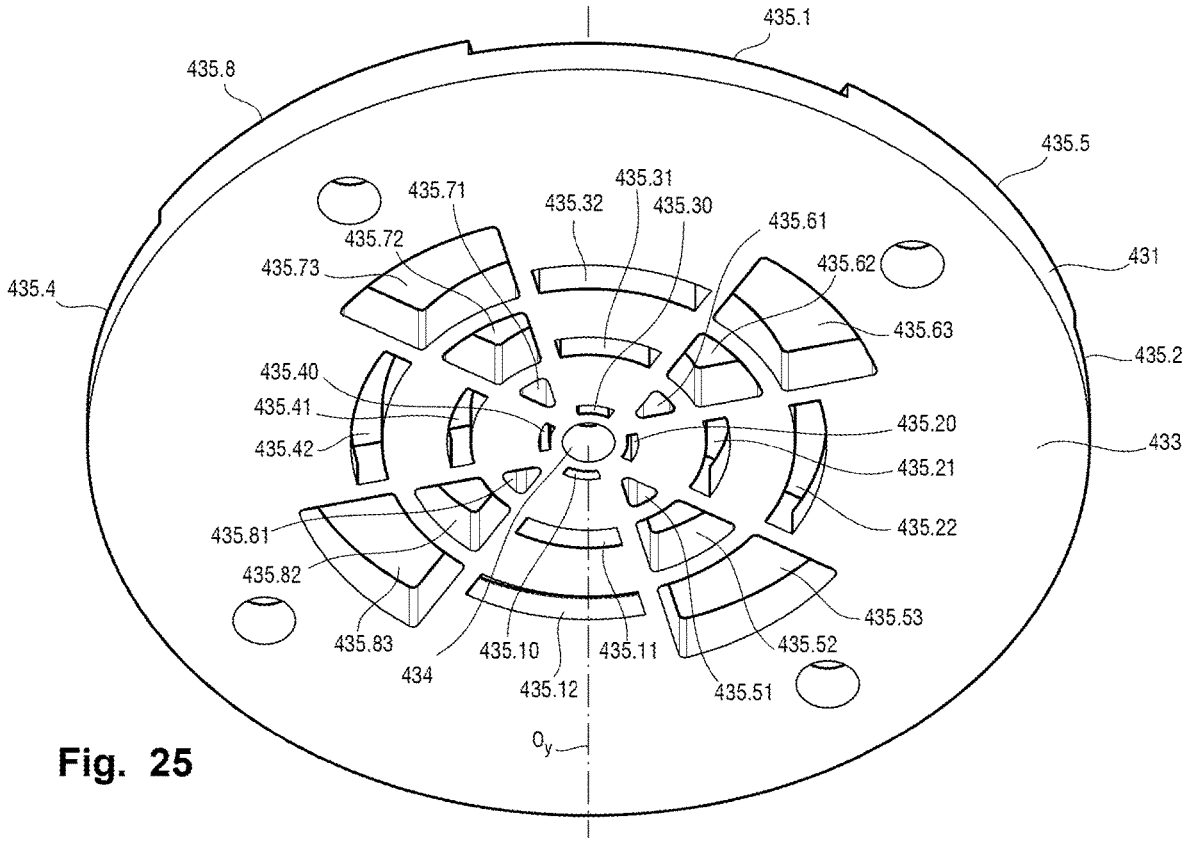

With reference to FIGS. 9 to 11, the Venturi ejector 201 of the third embodiment extends along a central axis Oy and comprises a feed block 210 and a suction block 220 that are identical and substantially in the form of disks about the central axis Oy. The feed and suction blocks 210 and 220 are mounted symmetrically relative to the plane P. A first mixer body 231 is screwed onto the bottom face 212 of the feed block 210. A second mixer body 241 identical to the first mixer body 231 is mounted symmetrically relative thereto about a plane P orthogonal to the central axis Oy and is screwed onto the top face 221 of the suction block 220 and extends in register with the first mixer body 231.

A top cover 228 and a bottom cover 248 co-operate respectively with the top face 211 of the feed block 210 and with the bottom face 222 of the suction block 120 to define a first suction chamber 205 and a second suction chamber 208. The bottom face 212 of the feed block 210 includes a first cylindrical central housing 260 connected to the top face 211 of the feed block 210 by a central duct 261. The bottom face 212 of the feed block 210 also has five annular grooves concentric about the central axis Oy: a first groove 263 for receiving an O-ring 264, a collector second groove 265, a third groove 266 for receiving an O-ring 267, a collector fourth groove 268, and a fifth groove 269 for receiving an O-ring 270. A first set of eight channels 271 that are symmetrically distributed around the central axis Oy and each comprising a first portion 271.1 extending substantially at 45° relative to the central axis Oy and a second portion 271.2 parallel to the central axis Oy serves to connect the first central housing 260 to the top face 211 of the feed block 210. A second set of eight channels 272 that are distributed symmetrically around the central axis Oy and that extend parallel to the central axis Oy serves to connect the bottom of the second groove 265 to the top face 211 of the feed block 210. Eight flaps 273.1 to 273.8 installed at the junctions between the second groove 265 and each of the channels 272 are arranged so as to oppose fluid flow from the second groove 265 to each of the channels 272.

A third set of eight channels 274 that are distributed symmetrically around the central axis Oy and that extend parallel to the central axis Oy serves to connect the bottom of the fourth groove 268 to the top face 211 of the feed block 210. Eight flaps 275.1 to 275.8 installed at the junctions between the fourth groove 268 and each of the channels 274 are arranged so as to oppose fluid flow from the fourth groove 268 to each of the channels 274.

Thus, the first central housing 260 and the second and fourth grooves 265 and 268 are in fluid-flow connection with the second suction chamber 208.

Since the feed block 210 is identical to the suction block 220, the top face 221 of the suction block 220 includes a second cylindrical central housing 280 that is connected to the bottom face 222 of the suction block 220 by a central duct 281. The top face 221 of the suction block 220 also has five annular grooves concentric about the central axis Oy: a sixth groove 283 for receiving an O-ring 284, a collector seventh groove 285, an eighth groove 286 for receiving an O-ring 287, a collector ninth groove 288, and a tenth groove 289 for receiving an O-ring 290. A fourth set of eight channels 291 that are symmetrically distributed around the central axis Oy and each comprising a first portion 291.1 extending substantially at 45° relative to the central axis Oy and a second portion 291.2 parallel to the central axis Oy serves to connect the second central housing 280 the bottom face 222 of the suction block 220. A fifth set of eight channels 292 that are distributed symmetrically around the central axis Oy and that extend parallel to the central axis Oy serves to connect the bottom of the seventh groove 285 to the bottom face 222 of the suction block 220. Eight flaps 293.1 to 293.8 installed at the junctions between the seventh groove 285 and each of the channels 292 are arranged so as to oppose fluid flow from the seventh groove 285 to each of the channels 292.

A sixth set of eight channels 294 that are distributed symmetrically around the central axis Oy and that extend parallel to the central axis Oy serves to connect the bottom of the ninth groove 288 to the bottom face 222 of the suction block 220. Eight flaps 295.1 to 295.8 installed at the junctions between the ninth groove 288 and each of the channels 294 are arranged so as to oppose fluid flow from the ninth groove 288 to each of the channels 294.

Thus, the second central housing 280 and the seventh and ninth grooves 285 and 288 are in fluid-flow connection with the first suction chamber 205.

Eight tubular spacers 250.1 to 250.8 respectively engaged firstly in the feed block 210 and secondly in the suction block 220 extend parallel to the central axis Oy and provide fluid-flow connection between the second suction chamber 208 and the first suction chamber 205, which is itself connected to the volume 225.

With reference to FIG. 10, the first mixer body 231 is substantially in the form of a disk about the central axis Oy and includes a first central hole 234, a right cylinder in this example, that connects together the top face 233 and the bottom face 235 of the first mixer body 231. The first central hole 234 opens out into the central housing 260 of the feed body 210. The first mixer body 231 comprises a first annular portion 276, a second annular portion 277, and a third annular portion 278, which annular portions are mutually concentric and have respective thicknesses $e_{276}$, $e_{277}$, and $e_{278}$ The thickness $e_{276}$ of the first annular portion 276 is greater than the thickness $e_{277}$ of the second annular portion, which is itself greater than the thickness $e_{278}$ of the third annular portion 278 so as to constitute a first mixer body 231 having a bottom face 235 that is stepped. Eight first through slots 276.1 symmetrically distributed around the central axis Oy extend over an angular sector of about thirty-five degrees between the first portion 276 and the second portion 277. Eight second through slots 277.1 symmetrically distributed around the central axis Oy extend over an angular sector of about thirty-five degrees between the second portion 277 and the third portion 278. The first and second slots 276.1 and 277.1 serve to connect the bottom face 235 of the first mixer body 231 respectively with the collector second groove 265 and with the collector fourth groove 268.

A tube 279 is engaged in sealed manner in the central duct 261 and it extends in the first central housing 260 and through the central hole 234.

The second mixer body 241 is substantially in the form of a disk of central axis Oy and it includes a second central hole 244, a right cylinder in this example, that connects together the bottom face 243 and the top face 245 of the second mixer body 241. The second central hole 244 opens out into the central housing 280 of the suction body 220. The second mixer body 241 comprises a fourth annular portion 296, a fifth annular portion 297, and a sixth annular portion 298, which annular portions are mutually concentric and have respective thicknesses $e_{296}$, $e_{297}$, and $e_{298}$. The thickness $e_{296}$ of the fourth annular portion 296 is greater than the thickness $e_{297}$ of the fifth annular portion, which is itself greater than the thickness $e_{278}$ of the sixth annular portion 278 so as to constitute a second mixer body 241 having its top face 245 that is stepped. Eight third through slots 296.1 symmetrically distributed around the central axis Oy extend over an angular sector of about thirty-five degrees between the first portion 296 and the second portion 297. Eight fourth through slots 297.1 symmetrically distributed around the central axis Oy extend over an angular sector of about thirty-five degrees between the second portion 297 and the third portion 298. The third slots of 296.1 and the fourth slots 297.1 connect the top face 245 of the second mixer body 241 respectively with the collector seventh groove 285 and with the collector ninth groove 288.

A blind tube 299 is engaged in sealed manner in the central duct 281 and it extends in the second central housing 280 and through the central hole 244.

The central duct 261 and the tube 279 define a feed duct 202 for feeding the ejector 201 with compressed air. Together with the sixth annular portion 296 of the top face 245 of the second mixer body 241 and the bottom and top ends 216 and 223.1 respectively of the tube 279 and of the blind tube 299, the bottom face 235 of the first annular portion 276 of the first mixer body 231 defines the following chambers:

an annular first expansion chamber 203 defined by the two non-touching ends of the bottom and top ends 216 and 223.1 respectively of the tube 279 and of the blind tube 299. The annular first expansion chamber 203 has a first fluid inlet 203.1 in the form of a free right cylindrical section extending between the feed duct 202 and the top end 223.1 of the blind tube 299;

an annular first mixing chamber 204 connected to a first fluid outlet 203.2 of the first expansion chamber 203;

an annular first intermediate suction chamber 205.1 defined by the first central hole 234 and the outer wall of the tube 279 and connected to a first suction port 204.1 of the annular first mixing chamber 204. The annular first intermediate suction chamber 205.1 is connected to the first suction chamber 205 by the first central housing 260 and the first set of channels 271;

an annular first exhaust chamber 206 connected to a first exhaust port 204.2 of the mixing chamber 204; and an annular second intermediate suction chamber 208.1 defined by the second central hole 244 and the outer wall of the tube 299 and connected to a second suction port 204.3 of the mixing chamber 204. The annular second intermediate suction chamber 208.1 is connected to the second suction chamber 208 by the second central housing 280 and the fourth set of channels 291.

Together with the seventh annular portion 297 of the top face 245 of the second mixer body 241, the bottom face 235 of the second annular portion 277 of the first mixer body 231 defines a first additional expansion stage comprising the following chambers:

a second expansion chamber 1203 having a second fluid inlet 1203.1 connected to the first exhaust chamber 206;

a second mixing chamber 1204 connected to a second fluid outlet 1203.2 of the second expansion chamber 1203;

a third intermediate suction chamber 1205.1 defined by the slots 276.1 and connected to a third suction port 1204.1 of the second mixing chamber 1204. The third intermediate suction chamber 1205.1 opens out into the collector second groove 265 and is connected to the first suction chamber 205 by the second set of channels 272, each of the eight channels 272 being fitted with a respective flap 273.1 to 273.8;

a second exhaust chamber 1206 connected to a second exhaust port 1204.2 of the second mixing chamber 1204; and a fourth intermediate suction chamber 1208.1 defined by the slots 296.1 and connected to a fourth suction port 1204.3 of the second mixing chamber 1204. The fourth intermediate suction chamber 1208.1 opens out into the collector seventh groove 285 and is connected to the second suction chamber 208 by the fifth set of channels 292, each of the eight channels 292 being fitted with a respective flap 293.1 to 293.8.

The second expansion, mixing, and exhaust chambers 1203, 1204, and 1206 are annular chambers about the central axis Oy.

Together with the top face 245 of the eighth annular portion 298 of the second mixer body 241, the bottom face 235 of the third annular portion 278 of the first mixer body 231 defines a second additional expansion stage comprising the following chambers:

a third expansion chamber 2203 having a second fluid inlet 2203.1 connected to the second exhaust chamber 1206;

a third mixing chamber 2204 connected to a second fluid outlet 2203.2 of the third expansion chamber 2203;

a fifth intermediate suction chamber 2205.1 defined by the slots 297.1 and connected to a fifth suction port 2204.1 of the third mixing chamber 2204. The fifth intermediate suction chamber 2205.1 opens out into the collector ninth groove 288 and is connected to the first suction chamber 205 by the sixth set of channels 294, each of the eight channels 294 being fitted with a respective flap 295.1 to 295.8;

a third exhaust chamber 2206 connected to a second exhaust port 2204.2 of the third mixing chamber 2204; and a sixth intermediate suction chamber 2208.1 defined by the slots 277.1 and connected to a sixth suction port 2204.3 of the third mixing chamber 2204. The sixth intermediate suction chamber 1208.1 opens out into the collector fourth groove 268 and is connected to the second suction chamber 208 by the third set of channels 274, each of the eight channels 274 being fitted with a respective flap 275.1 to 275.8.

The third expansion, mixing, and exhaust chambers 2203, 2204, and 2206 are annular chambers about the central axis Oy.

A Venturi ejector 201 is thus obtained that comprises:

a compressed air feed duct 202;

a first expansion chamber 203 comprising a first compressed air inlet 3.1 connected to the feed duct 2;

a first mixing chamber 204 connected to a first fluid outlet 203.2 of the expansion chamber 203;

a first suction chamber 205 connected to a first suction port 204.1 of the first mixing chamber 204;

a second suction chamber 208 connected to a second suction port 204.3 of the first mixing chamber 4; and a first exhaust chamber 206 connected to a first exhaust port 204.2 of the first mixing chamber 204; and a first additional expansion stage comprising a second expansion chamber 1203, a second mixing chamber 1204, a third intermediate suction chamber 1205.1, a fourth intermediate suction chamber 1208.1, and a second exhaust chamber 1206; and a second additional expansion stage comprising a third expansion chamber 2203, a third mixing chamber 2204, a fifth intermediate suction chamber 2205.1, a fifth intermediate suction chamber 2208.1, and a third exhaust chamber 1206 communicating with an outlet port 207 of the ejector 201.

By mutual engagement, the volume 225 serves to make a connection to a network that is to be connected to reduced pressure, e.g. such as a suction cup (not shown). The feed duct 202 extends along the central axis Oy of the ejector 201 and the first expansion chamber 203, the first mixing chamber 204, the first suction chamber 205, and the first exhaust chamber 206 are annular chambers coaxial about the axis of the feed duct 2.

In operation, a vacuum generator 502 comprises a compressed air generator 501 (not shown) connected to the feed duct 202 of the Venturi ejector 201 in order to insert compressed air into the feed duct 202 along a direction E substantially parallel to the central axis Oy. The compressed air penetrates into the first expansion chamber 203 through the first inlet 203.1. It should be observed that the compressed air penetrates from the feed duct 2 into the expansion chamber 3 along a plurality of directions D extending over 360° in a plane that is substantially orthogonal to the central axis Oy, and thus to the direction E. The compressed air is subjected to expansion, thereby generating a reduction in pressure at the outlet from the expansion chamber 203. This pressure reduction creates suction at the first and second suction ports 204.1 and 204.3 respectively of the first and second intermediate suction chambers 205.1 and 205.8. This pressure reduction is communicated to the first and second suction chambers 205 and 208 via the channels 271 and 291 respectively. The pressure in the first and second suction chambers 205 and 208 is thus reduced, and this pressure reduction is communicated from the second suction chamber 208 to the first suction chamber 205 via the spacers 250.1 to 250.8. The pressure $P_{205}$ that obtains in the first suction chamber 205 holds the flaps 293.1 and 295.1 in the closed position so long as the pressures $P_{285}$ and $P_{288}$ that obtain respectively in the seventh and ninth grooves 285 and 288 are higher than the pressure $P_{205}$ that obtains in the first suction chamber 205. In corresponding manner, the pressure $P_{208}$ that obtains in the second suction chamber 208 holds the flaps 273.1 and 275.1 in the closed position so long as the pressures $P_{265}$ and $P_{268}$ that obtain respectively in the second and fourth grooves 265 and 268 are higher than the pressure $P_{208}$ that obtains in the second suction chamber 208.

Compressed air entering into the first additional expansion stage via the second fluid inlet 1203.1 is subjected to second expansion, thereby generating a pressure reduction at the outlet from the second expansion chamber 1203. This pressure reduction creates suction in the third and fourth suction ports 1204.1 and 1204.3 respectively of the third and fourth intermediate suction chambers 1205.1 and 1205.8, and also in the second and seventh grooves 265 and 285. When the pressures $P_{265}$ and $P_{285}$ that obtain respectively in the second and seventh grooves 265 and 285 are respectively less than the pressures $P_{208}$ and $P_{205}$ that obtain in the second and first suction chambers 208 and 205, the flaps 273.1 and 275.1 open and the suction flow rate in the volume 225 increases.

The second additional expansion stage operates in identical manner to the first.

With reference to FIGS. 12 to 19, the Venturi ejector 301 of the fourth embodiment extends along a central axis Oy and comprises a feed block 310 and a suction block 320 that are substantially in the form of right cylinders about the central axis Oy. A first mixer body 331 is fitted to the bottom face 312 of the feed block 310. A second mixer body 341 is fitted to the top face 321 of the suction block 320 and extends in register with the first mixer body 331.

The feed block 310, and the first and second mixer bodies 331 and 341 include diametrically opposite holes 3001 and 3002 that receive respective hex socket head cap (HSHC) screws 3003 and 3004 having their threaded ends 3003.1 and 3004.1 co-operating with respective tapped holes 3005 and 3006 in the suction block 320.

The feed block 310 is a cylinder having its axis coinciding with the central axis Oy, and it has a top face 311 and a bottom face 312 having at its center a tubular duct 313 extending along the central axis Oy. A bore 314 connects the top face 311 of the feed block 310 to the inside volume of the duct 313.

The bottom face 312 includes a first circular groove 3007 for receiving an O-ring 3008.

The first mixer body 331 is in the form of a disk having its axis coinciding with the central axis Oy and it includes a central hole 334 connecting together the top face 333 and the bottom face 335 of the first mixer body 331. The top face 333 includes a second circular groove 3009 for receiving an O-ring 3010. The top face 333 also includes an annular housing 3011. A first set of two diametrically opposite slots 3012 and 3013 connect together the housing 3011 and the bottom face 335 of the first mixer body 331. A second set of two diametrically opposite slots 3014 and 3015, which are situated at 90° about the central axis Oy relative to the first set of slots 3012 and 3013, connect together the housing 3011 and the bottom face 335 of the first mixer body 331.

The slots 3012 and 3013 open out respectively into first and second recesses 335.1 and 335.2 in the bottom face 335. The sections of each of the first and second recesses 335.1 and 335.2, when considered in a plane P orthogonal to the central axis Oy, define respective forty-five degree angular sectors having their apexes situated on the central axis Oy.

The second mixer body 341 is in the form of a right cylinder having its axis coinciding with the central axis Oy and it includes a cylindrical setback 3016 on the central axis Oy. The second mixer body 341 also has a third set of two slots 3017 and 3018 connecting together a top face 345 of the second mixer body 341 and the inside of the setback 3016. A fourth set of two diametrically opposite slots 3019 and 3020, which are situated at 90° to the third set of slots 3017 and 3018, connect together the top face 345 of the second mixer body 341 and the inside of the setback 3016. The slots 3019 and 3020 are bordered respectively by third and fourth grooves 3021 and 3022 that receive respective gaskets 3023 and 3024.

The slots 3017 and 3018 open out respectively into third and fourth recesses 345.1 and 345.2 in the top face 345. The sections of each of the third and fourth recesses 345.1 and 345.2, when considered in a plane P orthogonal to the central axis Oy, define respective forty-five degree angular sectors having their apexes situated on the central axis Oy.

The suction block 320 is a cylinder having its axis coinciding with the central axis Oy, and it has a top face 321 and a bottom face 322 having at its center a cylindrical feed duct 326 extending along the central axis Oy. The top face 321 includes a fifth circular groove 3025 for receiving an O-ring 3027.

Once the feed block 310, the first mixer body 331, the second mixer body 341, and the suction block 320 have been assembled together by screw fastening, the first and third recesses 335.1 and 345.1 are in register with each other and define a first housing 3028. The second and fourth recesses 335.2 and 345.2 are in register with each other and define a second housing 3029.

The respective bases 335.3, 335.4, 345.3, and 345.4 of the recesses 335.1, 335.2, 345.1, and 345.2 extend parallel to the plane P and they are spaced apart by a distance e. Thus, the respective annular sections 3030 and 3031 of the first housing 3028 and of the second housing 3029 increase progressively on going away from the central axis Oy.

In the meaning of the present application, the annular section of a housing is its section considered on a right cylindrical surface about the central axis Oy.

Together with the duct 313, the volume defined by the bore 314 defines a feed duct 302 for feeding compressed air to the ejector 301. The feed duct 302 is thus a cylindrical volume of central axis Oy. Assembling the first and second mixer bodies 331 and 341 together with the feed and suction blocks 310 and 320 defines the following volumes:

- a first main expansion chamber 303.3 and a first secondary expansion chamber 303.4 defined respectively firstly by the portions of the housings 3028 and 3029 that lie between the hole 334 and the slots 3012 and 3017 for the first main expansion chamber 303.3 and secondly by the slots 3017 and 3018 for the first secondary expansion chamber 303.4. The first main expansion chamber 303.3 has a first fluid inlet 303.10 in the form of a free portion of the hole 334 in communication with the housing 3028. The first secondary expansion chamber 303.4 has a first fluid inlet 303.11 in the form of a free portion of the hole 334 in communication with the housing 3029;

a first main mixing chamber 304.10 connected to a fluid outlet 303.20 of the first main expansion chamber 303.3;

a first secondary mixing chamber 304.20 connected to a fluid outlet 303.21 of the first secondary expansion chamber 303.4;

a first suction chamber 305 connected to a first suction port 304.11 of the main mixing chamber 304.10 and to a first suction port 304.12 of the secondary mixing chamber 304.20;

a main exhaust chamber 306.1 connected to a first exhaust port 304.21 of the main mixing chamber 304.10 and that communicates with a main outlet port 307.1 of the ejector 301;

a secondary exhaust chamber 306.2 connected to a first exhaust port 304.22 of the secondary mixing chamber 304.20 and that communicates with a secondary outlet port 307.2 of the ejector 301; and a second suction chamber 308 of annular shape, and corresponding to the housing 3011, is connected to a second suction port 304.31 of the main mixing chamber 304.10 and to a second suction port 304.32 of the secondary mixing chamber 304.20.

The slots 3014 and 3019, which are connected together in a manner that is sealed by the gasket 3023, and also the slots 3015 and 3020, which are connected together in a manner sealed by the gasket 3024, serve to put the first and second suction chambers 305 and 308 into fluid-flow connection.

In operation, a vacuum generator 600 (not shown) comprises a compressed air generator 601 (not shown) connected to the feed duct 302 of the Venturi ejector 301 in order to insert compressed air into the feed duct 302 along a direction E substantially parallel to the central axis Oy. Thereafter, the compressed air penetrates into the first main and secondary expansion chambers 303.3 and 303.4 through the first inlets 303.10 and 303.11 along a plurality of directions—in this example extending along two forty-five degree angular sectors having their apexes situated on the central axis Oy—which directions lie in a plane that is substantially orthogonal to the central axis (Oy). The difference in section between the feed duct 302 and the first inlets 303.10 and 303.11 leads to an acceleration of the compressed air as it enters into the first main and secondary expansion chambers 303.3 and 303.4. The increase in annular section with increasing distance between the section under consideration and the axis of revolution gives rise to an increasing flow section going from the first inlets 303.10 and 303.11 to the first fluid outlets 303.20 and 303.21. The compressed air is thus subjected to expansion, thereby generating a reduction in pressure at the outlet from the main and secondary expansion chambers 303.3 and 303.4. This pressure reduction creates suction at the first and second suction ports 304.11, 304.12 and 304.31, 304.32 respectively of the first and second suction chambers 305 and 308. The pressure in the first and second suction chambers 305 and 308 is thus reduced, and this pressure reduction is communicated from the second suction chamber 308 to the first suction chamber 305 via the slots 3014, 3019, 3015, and 3020. The suction channel 326 is at reduced pressure, and, on being connected to the suction channel 326, a network of handling suction cups for connection to reduced pressure receives the reduced pressure necessary for generating suction in the network of suction cups.

The Venturi ejector 301 of the invention is more compact than prior art ejectors and has also been found to be remarkably less noisy. Construction by stacking simple parts that are assembled together by screw fastening is also particularly inexpensive.

Since compressed air is no longer injected into the expansion chambers over three hundred and sixty degrees, but rather over two annular portions, each of forty-five degrees, the thicknesses of the flow sections can be increased proportionally for identical consumed flow rate (proportional to the total area of the inlet sections 303.10 and 303.11). This makes it possible to reduce constraints on manufacturing tolerances relating to the recesses 335.1, 335.2, 345.1, and 345.2 in the parts 331 and 341, and thus to reduce the cost of those parts, while conserving the same accuracy concerning control over the area of the flow sections and thus control over the consumed flow rate and the performance of the ejector.

With reference to FIGS. 20 to 30, the Venturi ejector 401 of the fifth embodiment extends along a central axis Oy and comprises a feed block 410 and a suction block 420 that are substantially in the form of right cylinders about the central axis Oy. A first mixer body 431 is fitted to the bottom face 412 of the feed block 410. A second mixer body 441 is fitted to the top face 421 of the suction block 420 and extends in register with the first mixer body 431.

The feed blocks 410, and the first and second mixer bodies 431 and 441 include four through holes 4001, 4002, 4003, and 4004 distributed at ninety degrees to one another and receiving respective HSHC screws 4005, 4006, 4007, and 4008 having their threaded ends 4005.1, 4006.1, 4007.1, and 4008.1 co-operating with respective tapped holes 4005.2, 4006.2, 4007.2, and 4008.2 in the suction block 420.

The feed block 410 is a cylinder of axis coinciding with the central axis Oy and having a top face 411 and a bottom face 412 that are connected together by a central cylindrical duct 413 extending through the feed block 410 along the central axis Oy.

The bottom face 412 includes a first annular housing 4009, a second annular housing 4010, and a third annular housing 4011 that are defined by the following right cylindrical walls about the central axis Oy:

a first wall 4012 beside the duct 413;

a second wall 4013 that co-operates with the first wall 4012 to define the first housing 4009;

a third wall 4014 that co-operates with the second wall 4013 to define the second housing 4010; and a fourth wall 4015 that co-operates with the third wall 4014 to define the third housing 4011.

The first, second, third, and fourth walls 4012, 4013, 4014, and 4015 are concentric, and in their tops they include respective first, second, third, and fourth grooves 4012.1, 4013.1, 4014.1, and 4015.1 for receiving respective O-rings 4012.2, 4013.2, 4014.2, and 4015.2.

The first mixer body 431 is in the form of a right cylinder having its axis coinciding with the central axis Oy and it includes a central hole 434 connecting together the top face 433 and the bottom face 435 of the first mixer body 431. The bottom face 435 includes first, second, third, and fourth recesses 435.1, 435.2, 435.3, and 435.4, each of section considered in a plane P orthogonal to the central axis Oy that defines a respective forty-five degree angular sector of apex situated on the central axis Oy.

The first, second, third, and fourth recesses 435.1, 435.2, 435.3, and 435.4 are positioned at ninety degrees from one another around the central axis Oy.

The first recess 435.1 includes first, second, and third concentric slots 435.10, 435.11, and 435.12 in the form of angular sectors centered on the central axis Oy. The distances between the first, second, and third slots 435.10, 435.11, and 435.12, and also their radial dimensions, are selected in such a manner that they open out respectively into the first housing 4009, the second housing 4010, and the third housing 4011 in the feed block 410 when the Venturi ejector 401 is assembled.

In corresponding manner, the second recess 435.2 includes concentric fourth, fifth, and sixth slots 435.20, 435.21, and 435.22 in the form of angular sectors centered on the central axis Oy. The distances between the fourth, fifth, and sixth slots 435.20, 435.21, and 435.22, and also their radial dimensions, are selected in such a manner that they open out respectively into the first housing 4009, the second housing 4010, and the third housing 4011 in the feed block 410 when the Venturi ejector 401 is assembled.

In corresponding manner, the third recess 435.3 includes concentric seventh, eighth, and ninth slots 435.30, 435.31, and 435.32 in the form of angular sectors centered on the central axis Oy. The distances between the seventh, eighth, and ninth slots 435.30, 435.31, and 435.32, and also their radial dimensions, are selected in such a manner that they open out respectively into the first housing 4009, the second housing 4010, and the third housing 4011 in the feed block 410 when the Venturi ejector 401 is assembled.

In corresponding manner, the fourth recess 435.4 includes concentric tenth, eleventh, and twelfth slots 435.40, 435.41, and 435.42 in the form of angular sectors centered on the central axis Oy. The distances between the tenth, eleventh, and twelfth slots 435.40, 435.41, and 435.42, and also their radial dimensions, are selected in such a manner that they open out respectively into the first housing 4009, the second housing 4010, and the third housing 4011 in the feed block 410 when the Venturi ejector 401 is assembled.

The first, second, third, and fourth recesses 435.1 to 435.4 define four sectors 435.5, 435.6, 435.7, and 435.8—angular sectors occupying forty-five degrees in this example—each including three through slots. Thus, the first sector 435.5 includes a thirteenth slot 435.51, a fourteenth slot 435.52, and a fifteenth slot 435.53 respectively in fluid-flow communication with the first housing 4009, the second housing 4010, and the third housing 4011 in the feed block 410 when the Venturi ejector 401 is assembled. In corresponding manner, the second sector 435.6 includes a sixteenth slot 435.61, a seventeenth slot 435.62, and an eighteenth slot 435.63 respectively in fluid-flow communication with the first housing 4009, the second housing 4010, and the third housing 4011 in the feed block 410 when the Venturi ejector 401 is assembled. The third sector 435.7 includes a nineteenth slot 435.71, a twentieth slot 435.72, and a twenty-first slot 435.73 respectively in fluid-flow communication with the first housing 4009, the second housing 4010, and the third housing 4011 in the feed block 410 when the Venturi ejector 401 is assembled. Finally, the fourth sector 435.8 includes a twenty-second slot 435.81, a twenty-third slot 435.82, and a twenty-fourth slot 435.83 respectively in fluid-flow communication with the first housing 4009, the second housing 4010, and the third housing 4011 in the feed block 410 when the Venturi ejector 401 is assembled.

The suction block 420 is a cylinder of axis coinciding with the central axis Oy and including a central duct 426 connecting together the top face 421 and the bottom face 422 of the suction block 420.

The top face 421 includes a fourth annular housing 4016 and a fifth annular housing 4017 that are defined by the following right cylindrical walls about the central axis OY:

- a fifth wall 4018 beside the duct 426;
- a sixth wall 4019 co-operating with the fifth wall 4018 to define the fourth housing 4016; and
- a seventh wall 4020 co-operating with the sixth wall 4019 to define the fifth housing 4017.

The fifth, sixth, and seventh walls 4018, 4019, and 4020 are concentric and in their tops they include respective fifth, sixth, and seventh grooves 4018.1, 4019.1, and 4020.1 for receiving respective O-rings 4018.2, 4019.2, and 4028.2.

Figure 26:
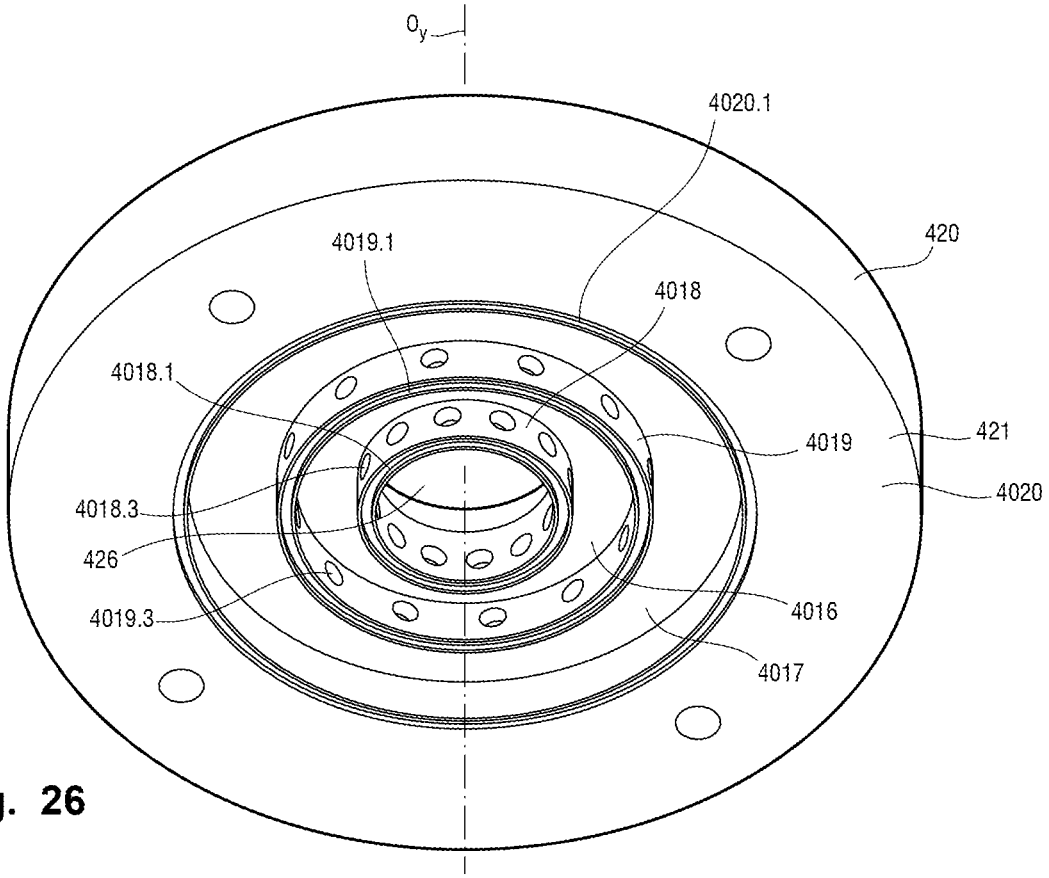
FIGS. 26 and 27 are perspective views of a suction block in the fifth embodiment of the invention.
Figure 27:
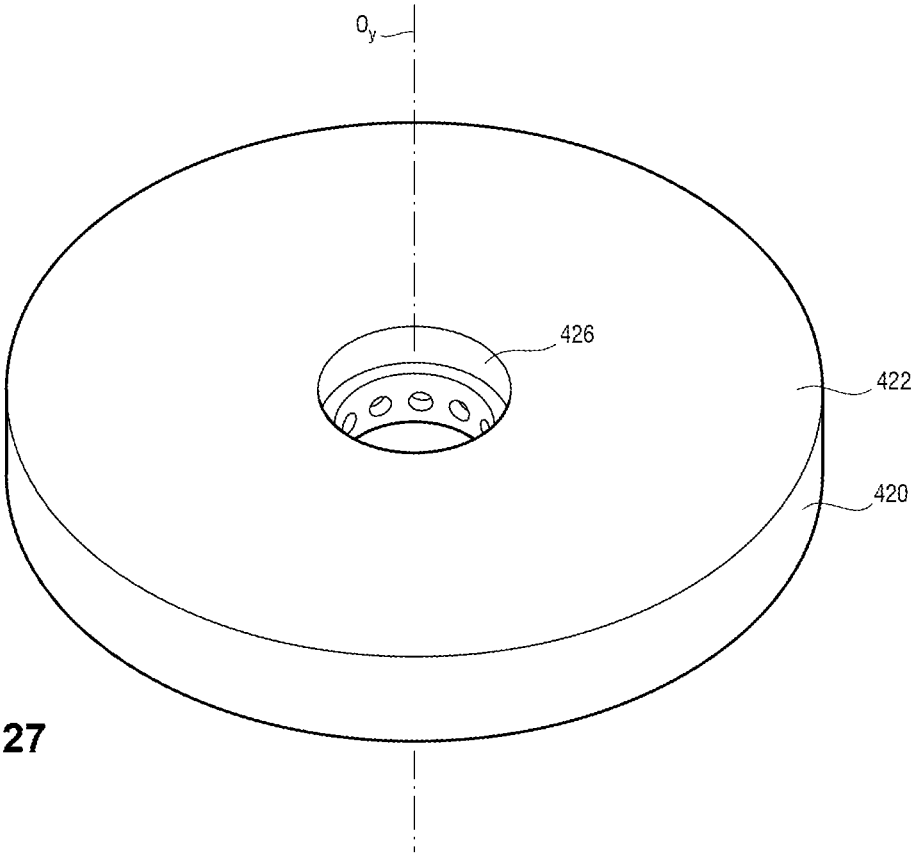
Figure 28:
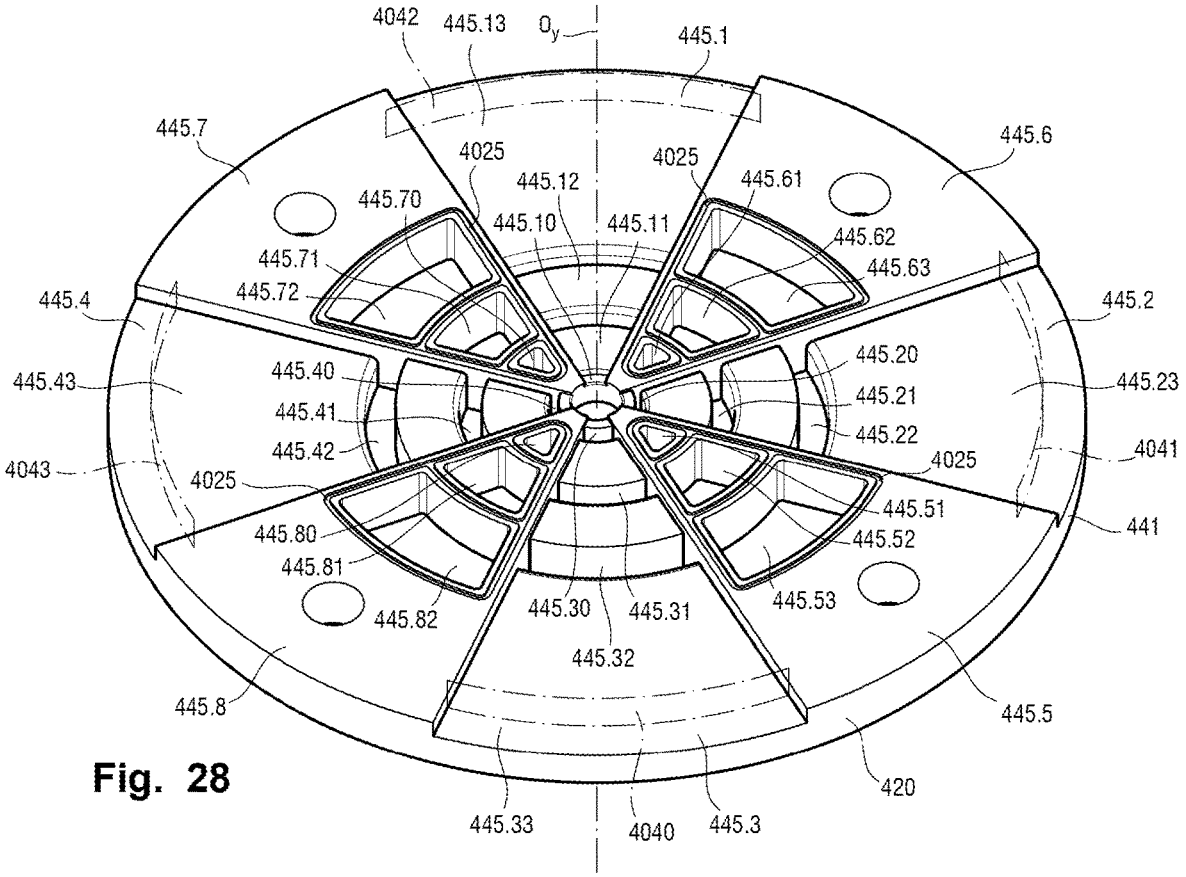
FIGS. 28 and 29 are perspective views of a second mixer body in the fifth embodiment of the invention.
Figure 29:
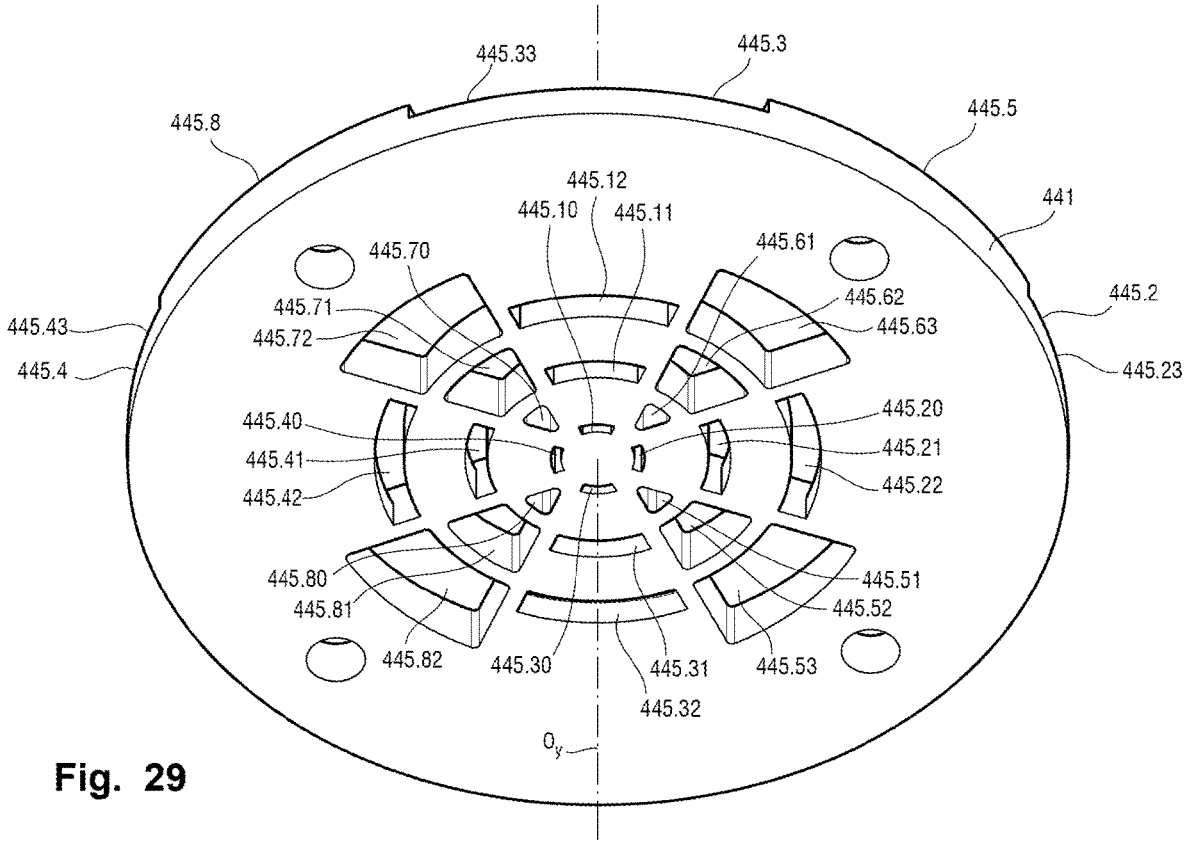
Figure 30:
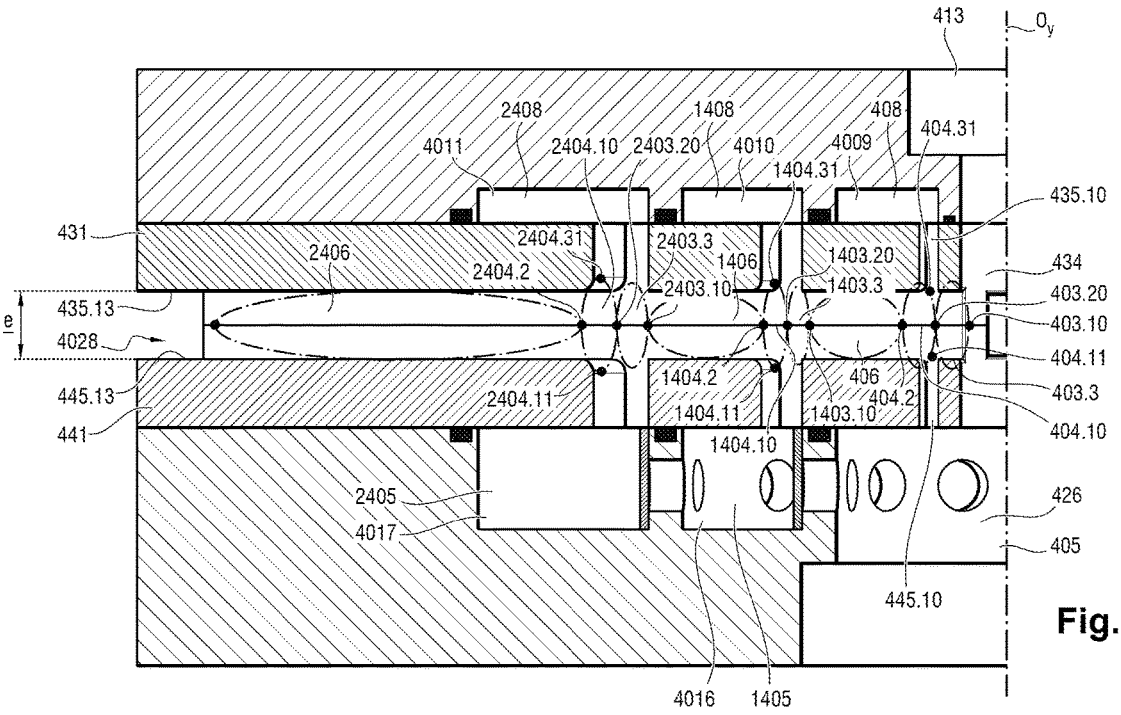
FIG. 30 is a longitudinal section view of the FIG. 20 ejector.

As can be seen in FIG. 26, the fifth wall 4018 and the sixth wall 4019 possess radial holes 4018.3 and 4019.3. A first elastomer strip 4021 having C-shaped cutouts 4022 extends over the outside face of the fifth wall 4018 so that each cutout 4022 extends in register with a hole 4018.3. A second elastomer strip 4023 having C-shaped cutouts 4024 extends over the outside face of the seventh wall 4019 so that each cutout 4024 extends in register with a hole 4019.3. The cutouts 4022 in the first strip 4021 act on the holes 4018.3 like flaps allowing fluid to pass from the duct 426 to the fourth housing 4016. The cutouts 4024 in the second strip 4023 act on the holes 4019.3 like flaps allowing fluid to pass from the fourth housing 4016 to the fifth housing 4017.

The second mixer body 441 is identical to the first mixer body 431 and thus includes fifth, sixth, seventh, and eighth recesses 445.1, 445.2, 445.3, & 445.4 and fifth, sixth, seventh, and eighth sectors 445.5, 445.6, 445.7, & 445.8.

The fifth recess 445.1 includes concentric twenty-fifth, twenty-sixth, and twenty-seventh slots 445.10, 445.11, and 445.12 in the form of angular sectors centered on the central axis Oy. The distances between the twenty-fifth, twenty-sixth, and twenty-seventh slots 445.10, 445.11, and 445.12, and also their radial dimensions, are selected in such a manner that they open out respectively into the duct 426, into the fourth housing 4016, and into the fifth housing 4017 of the suction block 420 when the Venturi ejector 401 is assembled.

The sixth recess 445.2 includes concentric twenty-eighth, twenty-ninth, and thirtieth slots 445.20, 445.21, and 445.22 in the form of angular sectors centered on the central axis Oy. The distances between the twenty-eighth, twenty-ninth, and thirtieth slots 445.20, 445.21, and 445.22, and also their radial dimensions, are selected in such a manner that they open out respectively into the duct 426, into the fourth housing 4016, and into the fifth housing 4017 of the suction block 420 when the Venturi ejector 401 is assembled.

In corresponding manner, the seventh recess 445.3 includes concentric thirty-first, thirty-second, and thirty-third slots 445.30, 445.31, and 445.32 in the form of angular sectors centered on the central axis Oy. The distances between the thirty-first, thirty-second, and thirty-third slots 445.30, 445.31, and 445.32, and also their radial dimensions, are selected in such a manner that they open out respectively into the duct 426, into the fourth housing 4016, and into the fifth housing 4017 of the suction block 420 when the Venturi ejector 401 is assembled.

In corresponding manner, the eighth recess 445.4 comprises concentric thirty-fourth, thirty-fifth, and thirty-sixth slots 445.40, 445.41, and 445.42 in the form of angular sectors centered on the central axis Oy. The distances between the thirty-fourth, thirty-fifth, and thirty-sixth slots 445.40, 445.41, and 445.42, and also their radial dimensions, are selected in such a manner that they open out respectively into the duct 426, into the fourth housing 4016, and into the fifth housing 4017 of the suction block 420 when the Venturi ejector 401 is assembled. Each of the fifth, sixth, seventh, and eighth sectors 445.5, 445.6, 445.7, and 445.8 includes three through slots. Thus, the fifth sector 445.5 includes a thirty-seventh slot 445.51, a thirty-eighth slot 445.52, and a thirty-ninth slot 445.53 in fluid-flow communication respectively with the suction duct 426, with the fourth housing 4016, and with the fifth housing 4017 of the suction block 420 when the Venturi ejector 401 is assembled. In corresponding manner, the sixth sector 445.6 includes a fortieth slot 445.61, a forty-first slot 445.62, and a forty-second slot 445.63 in fluid-flow communication respectively with the suction duct 426, with the fourth housing 4016 and with the fifth housing 4017 of the suction block 420 when the Venturi ejector 401 is assembled. The seventh sector 445.7 includes a forty-third slot 445.71, a forty-fourth slot 445.72, and a forty-fifth slot 445.73 in fluid-flow communication respectively with the suction duct 426, with the fourth housing 4016, and with the fifth housing 4017 of the suction block 420 when the Venturi ejector 401 is assembled. Finally, the eighth sector 445.8 includes a forty-sixth slot 445.81, a forty-seventh slot 445.82, and a forty-eighth slot 445.83 in fluid-flow communication respectively with the suction duct 426, with the fourth housing 4016, and with the fifth housing 4017 of the suction block 420 when the Venturi ejector 401 is assembled.

All of the thirty-seventh to forty-eighth grooves 445.50 to 448.80 are surrounded by grooves 4025 for receiving respective O-rings 4027.

Once the feed block 410, the first mixer body 431, the second mixer body 441, and the suction block 420 have been assembled together by screw fastening, the first and fifth recesses 435.1 and 445.1 are in register with each other and define a first housing 4028. The second and sixth recesses 435.2 and 445.2 are in register with each other and define a second housing 4029. The third and seventh recesses 435.3 and 445.3 are in register with each other and define a third housing 4030. Finally, the fourth and eighth recesses 435.4 and 445.4 are in register with each other and define a fourth housing 4031.

The respective bases 435.13, 435.23, 435.33, 435.43, 445.13, 445.23, 445.33, and 445.43 of the recesses 435.1, 435.2, 435.3, 435.4, 445.1, 445.2, 445.3, and 445.4 extend parallel to the plane P in such a manner that the respective annular sections 4040, 4041, 4042, and 4043 of the first, second, third, and fourth housings 4028 to 4031 increase progressively on going away from the central axis Oy.

Assembling the first and second mixer bodies 431 and 441 together with the feed and suction blocks 410 and 420 defines the following volumes in the first housing 4028:

- a first expansion chamber 403.3 defined by the housing portion 4028 extending between the hole 434 and the slots 435.10 and 445.10. The first expansion chamber 403.3 has a first fluid inlet 403.10 in the form of a free portion putting the hole 434 into communication with the housing 4028;
- a first mixing chamber 404.10 connected to a fluid outlet 403.20 of the first expansion chamber 403.3;
- a first suction chamber 405 (defined in this example by the duct 426) connected to a first suction port 404.11 of the first mixing chamber 404.10;
- a second suction chamber 408 of annular shape is connected to a second suction port 404.31 of the first mixing chamber 404.10. The second suction chamber 408 is defined by the first housing 4009;
- a first exhaust chamber 406 connected to a first exhaust port 404.2 of the first mixing chamber 404.10;
- a second expansion chamber 1403.3 having a second fluid inlet 1403.10 connected to the first exhaust chamber 406;
- a second mixing chamber 1404.10 connected to a second fluid outlet 1403.20 of the second expansion chamber 1403.3;
- a third suction chamber 1405 connected to a third suction port 1404.11 of the second mixing chamber 1404.10. The second suction chamber 1405 is defined by the fourth housing 4016;
- a fourth suction chamber 1408 connected to a fourth suction port 1404.31 of the second mixing chamber 1404.10. The fourth suction chamber 1408 is defined by the second housing 4010;
- a second exhaust chamber 1406 connected to a second exhaust port 1404.2 of the second mixing chamber 1404.10;
- a third expansion chamber 2403.3 having a third fluid inlet 2403.10 connected to the second exhaust chamber 1406;
- a third mixing chamber 2404.10 connected to a third fluid outlet 2403.20 of the third expansion chamber 2403.3;
- a fifth suction chamber 2405 connected to a fifth suction port 2404.11 of the third mixing chamber 2404.10. The third suction chamber 2405 is defined by the fifth housing 4017;
- a sixth suction chamber 2408 connected to a sixth suction port 2404.31 of the third mixing chamber 2404.10. The sixth suction chamber 2408 is defined by the third housing 4011; and
- a third exhaust chamber 2406 connected to a third exhaust port 2404.2 of the third mixing chamber 2404.10.

Together with the third and fourth suction chambers 1405 and 1408 and the second exhaust chamber 4006, the second expansion chamber 1403.3 and the second mixing chamber 1404.10 constitute a first additional expansion stage.

Together with the fifth and sixth suction chambers 2405 and 2408 and the third exhaust chamber 2406, the third expansion chamber 2403.3 and the third mixing chamber 2404.10 constitute a second additional expansion stage.

In corresponding manner, the second, third, and fourth housings 4029, 4030, and 4031 also define fourth to twelfth expansion chambers, fourth to twelfth mixing chambers, seventh to twenty-fourth suction chambers, and fourth to twelfth exhaust chambers.

The thirteenth, sixteenth, nineteenth, and twenty-second slots 435.51, 435.61, 435.71, and 435.81, which are connected in a manner that is sealed by the gaskets 4027 to the thirty-seventh, fortieth, forty-third, and forty-sixth slots 445.51, 445.61, 445.71, and 445.81, put the first housing 4009 into fluid-flow connection with the suction duct 426.

The fourteenth, seventeenth, twentieth, and twenty-third slots 435.52, 435.62, 435.72, and 435.82, which are connected in a manner that is sealed by the gaskets 4027 with the thirty-eighth, forty-first, forty-fourth, and forty-seventh slots 445.52, 445.62, 445.72, and 445.82, put the second housing 4010 in fluid-flow connection with the fourth housing 4016.

The fifteenth, eighteenth, twenty-first, and twenty-fourth slots, 435.53, 435.63, 435.73, and 435.83, which are connected in a manner sealed by the gaskets 4027 with the thirty-ninth, forty-second, forty-fifth, and forty-eighth slots 445.53, 445.63, 445.73, and 445.83, put the third housing 4011 in fluid-flow connection with the fifth housing 4017.

In operation, a vacuum generator 700 (not shown) comprises a compressed air generator 701 (not shown) connected to the feed duct 402—constituted by the duct 413 and the hole 434—of the Venturi ejector 401 in order to insert compressed air into the feed duct 402 along a direction E substantially parallel to the central axis Oy.

Vacuum generation is described below in detail with reference to the first housing 4028. The operation of the second, third, and fourth housings 4029 to 4031 is identical to that of the first housing 4028.

Compressed air penetrates into the first expansion chamber 403.3 through the first inlet 403.10. It should be observed that the compressed air penetrates from the feed duct 402 into the expansion chamber 403.3 along a plurality of directions D extending in a plane that is substantially orthogonal to the central axis Oy, and thus to the direction E. The compressed air is subjected to expansion, thereby generating a reduction in pressure at the outlet from the first expansion chamber 403.3. This pressure reduction creates suction at the first and second suction ports 404.11 and 404.31 respectively of the first and second suction chambers 405 and 408. The pressure in the first and second suction chambers 405 and 408 is then reduced. The first feed chamber 405 is connected to the duct 426 and the second suction chamber 408 is connected to the first housing 4009. The reduced pressure that obtains in the first housing 4009 is communicated to the first suction chamber 405 via the thirteenth and thirty-seventh slots 435.51 and 445.51, which are connected together in sealed manner. The pressure $P_{426}$ that obtains in the duct 426 holds the cutouts 4022 pressed against the holes 4018.3 in the closed position so long as the pressure $P_{4016}$ that obtains in the fourth housing 4016 is greater than the pressure $P_{426}$ that obtains in the suction duct 426.

Compressed air entering into the first additional expansion stage via the second fluid inlet 1403.10 is subjected to second expansion, thereby generating a pressure reduction at the outlet from the second expansion chamber 1403.3. This pressure reduction creates suction in the third and fourth suction ports 1404.11 and 1404.31 respectively of the third and fourth suction chambers 1405 and 1408, and also in the fourth and second housings 4016 and 4010. The reduced pressure that obtains in the second housing 4010 is communicated to the fourth housing 4016 via the sixteenth and fortieth slots 435.61 and 445.61, which are connected together in sealed manner. When the pressure $P_{4016}$ that obtains in the fourth housing 4016 is less than the pressure $P_{426}$ that obtains in the suction duct 426, the cutouts 4022 open, thereby releasing the holes 4018.3, and the suction flow rate in the duct 426 increases.

The second additional expansion stage operates in identical manner to the first.

The Venturi ejector 401 has four housings 4028 to 4031 for expanding compressed air and of section considered in a plane P orthogonal to the central axis Oy that describes a forty-five degree angular sector. The apex of each angular sector is situated on the central axis Oy.

Naturally, the invention is not limited to the embodiments described, but covers any variant coming within the ambit of the invention as defined by the claims.

In particular:

although above, the feed and suction blocks, the first and second mixer bodies, and the tubular spaces are assembled together using adhesive, the invention applies equally to other types of assembly means, e.g. such as ultrasonic welding, screw fastening or clipping, crimping, etc.;

although above, the suction block has four suction channels connecting the top face of the suction block to its inside volume, the invention applies equally to some other number of suction channels, e.g. such as one, two, three, or more than four;

although above, the ejector has eight tubular spacers distributed at forty-five degrees over a circle and connecting together the first and second suction chambers, the invention applies equally to an ejector that does not have a second suction chamber and therefore does not have tubular spacers, or indeed that has some other number of tubular spacers, e.g. such as fewer than eight tubular spacers or more than eight. The spacers may be distributed at any angle and over any curve;

although above, the mixer bodies have peripheral rims that are continuous, the invention applies equally to mixer bodies in which the rims are discontinuous and/or the rims are not peripheral, but are set back from the periphery;

although above, the ejector is described in use with compressed air, the invention applies equally to other types of fluid, e.g. other gases such as argon or oxygen, or indeed liquids;

although above, the network that is to be connected to reduced pressure is connected to the injector by mutual engagement, the invention applies equally to other types of connection interface, e.g. such as an endpiece for screw fastening, for clipping, or an adhesively bonded junction;

although above, the network that is to be connected to reduced pressure is a network of handling suction cups, the ejector could equally be used in other applications that require vacuum generation, e.g. suction applications or food vacuuming applications;

although above, the ejector has two pilot chambers and helical springs extending between the suction block and the feed block, the invention applies equally to other means for varying the volume of the first mixing chamber, e.g. such as one or more pneumatic jacks, one or more electric or pneumatic motors, or cams acting on the relative position of the suction and feed blocks;

although above, eight helical springs extend between the suction block and the feed block, the invention applies equally to some other number of springs and to other resilient means for applying a force to space apart the suction and feed blocks;

although above, the pilot pressure is constant, the invention applies equally to other ways of piloting the ejector, e.g. such as pilot pressure that is controlled by inserting compressed air into the pilot chambers via a proportional valve, itself controlled by a pressure-reduction sensor, or mechanical servocontrol using a vacuum-operated leakage valve;

although above, a set of eight channels connects the first central housing to the top face of the feed block, the invention applies equally to some other number of channels, e.g. such as a number in the range one to eight, or more than eight. This applies likewise to the channels connecting the bottoms of the grooves to the top face of the feed block. This is also true for all of the channels of the suction block;

although above, each of the first and fourth sets of channels comprises a portion extending substantially at 45° relative to the central axis, the invention applies equally to these portions having any orientation;

although above, the ejector includes a first additional expansion chamber and a second additional expansion chamber, the invention applies equally to some other number of additional expansion chambers, e.g. such as a single chamber or more than two;

although above, the ejector has eight first through slots that are distributed symmetrically around the central axis Oy and that extend over an angular sector of about thirty-five degrees between the first portion and the second portion, the invention applies equally to some other number and/or distribution of these slots. The dimensions and the shapes of the slots could also be modified;

although above, the first generator curves for generating expansion and mixing possess respective axes of symmetry that are orthogonal to the central axis, the invention applies equally to other types of generator curve e.g. such as curves each possessing a plurality of axes of symmetry capable of adopting any orientation relative to the central axis, or indeed curves of any kind, not having an axis of symmetry;

although above, the feed block, the first and second mixer bodies, and the suction block are assembled together using HSHC screws, the invention applies equally to other assembly means, e.g. such as bolts, adhesive, or force fitting.

although above, the sections of the recesses when considered in a plane P orthogonal to the central axis define forty-five degree angular sectors, the invention applies equally to angular sectors of other values, e.g. such as angles of less than forty-five degrees or of more than forty-five degrees, or even a single angular sector of three hundred and sixty degrees;

although above, the bases of the recesses form a non-zero angle with a plane orthogonal to the central axis, the invention applies equally to other means for increasing the annular section progressively on moving away from the central axis, e.g. such as a stepped configuration giving rise to the annular section increasing in discrete steps rather than continuously; and although above the ejector has one, two, or four expansion housings for the fluid under pressure, the invention applies equally to an ejector having three housings four expansion of the fluid, or more than four.

The invention claimed is:

1. A Venturi type ejector comprising:

a feed duct for feeding fluid under pressure;

a first expansion chamber having a first fluid inlet connected to the feed duct;

a first mixing chamber connected to a first fluid outlet of the expansion chamber;

a first suction chamber connected to a first suction port of the mixing chamber;

an exhaust chamber connected to a first exhaust port of the first mixing chamber and communicating with an outlet port of the ejector; and a connection interface for connection to a network that is to be connected to reduced pressure, which interface is in fluid-flow communication with the first suction chamber;

wherein the feed duct extends along a central axis of the ejector, and wherein the fluid under pressure penetrates into the first expansion chamber along a plurality of directions extending in a plane that is substantially orthogonal to the central axis, wherein the first mixing chamber includes a second suction port connected to a second suction chamber, the first and second suction chambers and being in fluid-flow connection, and wherein the first and second suction chambers and are connected together by at least one right cylinder having an axis parallel to the central axis.

2. The Venturi type ejector according to claim 1, further comprising including at least one housing for expansion of the fluid under pressure and of section, when considered in a plane that is orthogonal to the central axis, that defines an angular sector of apex situated on the central axis Oy.

3. The Venturi type ejector according to claim 2, wherein the first expansion chamber and/or the first mixing chamber and/or the first suction chamber are defined respectively by rotating a first expansion generator curve, a first mixing generator curve, and a first suction generator curve about the central axis.

4. The Venturi type ejector according to claim 3, wherein each of the first expansion and the mixing generator curves possesses an axis of symmetry that is orthogonal to the central axis.

5. The Venturi type ejector according to claim 1, wherein the first expansion chamber and/or the first mixing chamber and/or the first suction chamber form at least one annular chamber coaxial about the axis of the feed duct.

6. The Venturi type ejector according to claim 1, wherein the feed duct is a cylindrical volume of the central axis.

7. The Venturi type ejector according to claim 1, further comprising volume-varying means for varying the volume of the first mixing chamber.

8. The Venturi type ejector according to claim 1, further comprising at least one additional expansion stage comprising a second expansion chamber connected to a second mixing chamber, a suction port connecting the second mixing chamber to the first suction chamber, a flap being interposed between the suction port and the connection interface for connection to a network that is to be connected to reduced pressure.

9. The Venturi type ejector according to claim 1, further comprising:

a cylindrical feed block of axis that coincides with the central axis and that has a top face and a bottom face having at its center a cylindrical duct extending along the central axis, a bore connecting the top face of the feed block to the inside volume of the cylindrical duct;

a cylindrical suction block of axis coinciding with the central axis and having a top face and a bottom face, a suction channel connects the top face of the suction block to the bottom face of the suction block;

a first mixer body in the form of a disk of axis coinciding with the central axis and including a central hole connecting together a top face and a bottom face of the first mixer body; and a second mixer body in the form of a disk of axis coinciding with the central axis and including at least one hole connecting together a top face and a bottom face of the second mixer body;

wherein the first suction chamber is annular, and the first and/or second body being arranged to define at least one first housing of annular section that extending outwardly from the central axis.

10. The Venturi type ejector according to claim 9, further comprising a second housing of annular section that extending outwardly from the central axis.

11. A vacuum generator including a Venturi type ejector according to claim 1.

12. A Venturi type ejector comprising:

a feed duct for feeding fluid under pressure;

a first expansion chamber having a first fluid inlet connected to the feed duct;

a first mixing chamber connected to a first fluid outlet of the expansion chamber;

a first suction chamber connected to a first suction port of the mixing chamber;

an exhaust chamber connected to a first exhaust port of the first mixing chamber and communicating with an outlet port of the ejector;

a connection interface for connection to a network that is to be connected to reduced pressure, which interface is in fluid-flow communication with the first suction chamber;

a cylindrical feed block of axis that coincides with a central axis of the ejector and that has a top face and a bottom face having at its center a cylindrical tubular feed portion extending along the central axis, a bore connecting the top face of the feed block to the inside volume of the tubular feed portion;

a cylindrical suction block of axis coinciding with the central axis and that has a top face and a bottom face, a cylindrical blind tubular suction portion projects along the central axis, at least one suction channel connecting the top face of the suction block to the bottom face of the suction block;

a first mixer body in the form of a disk of axis coinciding with the central axis and having a first rim projecting axially from its top face, the first rim defining a first housing for receiving the feed block, the first mixer body including a central frustoconical hole connecting together the top face and the bottom face of the first mixer body, the greatest diameter of the frustoconical hole extending level with the top face of the first mixer body; and a second mixer body in the form of a disk of axis coinciding with the central axis and having a second rim projecting axially from its bottom face, the second rim defining a second housing for receiving the suction block, the second mixer body including a central frustoconical hole connecting together the top face and the bottom face of the second mixer body, the greatest diameter of the hole extending level with the bottom face of the second mixer body, wherein the feed duct extends along a central axis of the ejector, and wherein the fluid under pressure penetrates into the first expansion chamber along a plurality of directions extending in a plane that is substantially orthogonal to the central axis.

13. The Venturi type ejector according to claim 12, wherein the feed block, the suction block, and the first and second mixer bodies are assembled together by screw fastening.

14. The Venturi type ejector according to claim 12, wherein the first mixer body and the second mixer body are parts that are identical and that are mounted symmetrically about a plane that is orthogonal to the central axis.

15. A vacuum generator including a Venturi type ejector according to claim 12.

16. The Venturi type ejector according to claim 12, wherein the first expansion chamber and/or the first mixing chamber and/or the first suction chamber are annular chambers coaxial about the axis of the feed duct.

17. The Venturi type ejector according to claim 12, wherein the feed duct is a cylindrical volume of the central axis.

18. The Venturi type ejector according to claim 12, wherein the first mixing chamber includes a second suction port connected to a second suction chamber, the first and second suction chambers and being in fluid-flow connection.

19. The Venturi type ejector according to claim 18, wherein the first and second suction chambers and are connected together by at least one right cylinder having an axis parallel to the central axis.

* * * * *